US006190206B1

(12) United States Patent
Yang

(10) Patent No.: US 6,190,206 B1
(45) Date of Patent: Feb. 20, 2001

(54) CONDUCTOR COUPLING INCORPORATING A CONVEXO-CONCAVE COUPLING LABYRINTH SEPARATOR

(76) Inventor: Tai-Her Yang, No. 59, Chung Hsing 8 St., Si-Hu Town, Dzan-Hwa (TW)

( * ) Notice: Under 35 U.S.C. 154(b), the term of this patent shall be extended for 0 days.

(21) Appl. No.: 09/543,345

(22) Filed: Apr. 5, 2000

(51) Int. Cl.[7] ..... H01R 13/648

(52) U.S. Cl. ..... 439/608; 439/731; 439/456

(58) Field of Search ..... 439/456, 459, 439/578, 607, 608, 675, 736, 825, 884

(56) References Cited

U.S. PATENT DOCUMENTS

| | | | | |
|---|---|---|---|---|
| 5,906,511 | * | 5/1999 | Bozzer et al. | 439/608 |
| 5,926,952 | * | 7/1999 | Ito | 439/736 |
| 5,980,329 | * | 11/1999 | Klein et al. | 439/736 |
| 6,045,411 | * | 4/2000 | Huber et al. | 439/736 |

* cited by examiner

*Primary Examiner*—Khiem Nguyen
(74) *Attorney, Agent, or Firm*—Bacon & Thomas, PLLC

(57) ABSTRACT

Conductor Coupling or Control Interface incorporating a convexo-concave coupling labyrinth separator for separation from electromagnetic waves, comprising essentially: coated components as part of a conductor assembly or control interface, including, for example, conductor pin or contacts of a plug or socket assembly, switching or pushkey elements of a control interface, devices of acoustic power converted from electric power, those of electric power converted from acoustic power, those of optic power converted from electric power, and those of electric power converted from optic power, one-piece or assembled coating or covering components composed from insulator, closed (core filled), retiform or porous (hollow-set) metal or otherwise material impervious to electromagnetic penetration, whereof one or more section is treated curvatured, convex or concave, or in bent elbow, or in oblique bend, otherwise labyrinthine configured, suitably coupled with insulation to form a means of isolation, thence coupled by means of coupling or metal one the body of the control interface itself, or alternatively coating shell made from otherwise material impervious to electromagnetic penetration to form a tight coupling, the geometry being mutually shielding, for the purpose of convexo-concave textured isolation. This design of labyrinthine barrier to electromagnetic penetration in convexo-concave isolation may just as well as applied to the intake/outlet port of a shell casing to add to the shell casing the advantage of electromagnetic obstruction in addition to heat diffusion and ventilation purposes.

33 Claims, 49 Drawing Sheets

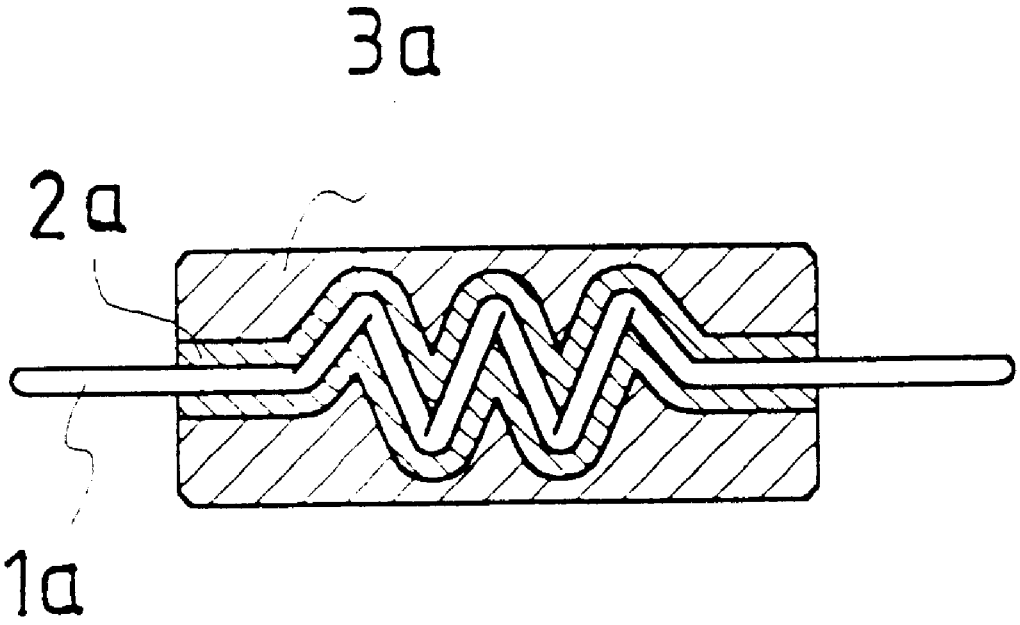
FIG. 2 4 A

CONDUCTOR COUPLING INCORPORATING A CONVEXO-CONCAVE COUPLING LABYRINTH SEPARATOR

BACKGROUND OF THE INVENTION (a) Field of the Invention

Design of Conductor Coupling or Control Interface incorporating a convexo-concave coupling labyrinth separator for separation from Electromagnetic Waves; comprising essentially: coating guides of conductor or control interface, such as: conductor pin or contacts of plugs or sockets, switching units of control interface or pushkey elements or speakers with its acoustic power derived from electric power, or microphone with its electric power derived from acoustic power, lamps with electric power derived from optic power, displays included, solar boards deriving its electric power from optic power, etc., coating architecture made from insulators, metals or other materials capable of insulating electromagnetic waves.

(b) Description of the Prior Art

With conductor coupling or control interface of known art, such as contacts, conductive adaptors used in or as part of plugs, sockets, electric appliances, computers, such as those shown in FIG. 1 through FIG. 4, coating guides such as conductor pin or contacts are processed to be pillar or pieces for planting unto insulators, so that aforementioned conductor pin or contacts, coating guides may rest secured in position. In practice, in said known art, said coating guides, said insulator, metal, or other coating, overlaying components or parts are either assembled parallel or else treated so that the contacts and the contact pins are configured convex or concave with respect to each other so as to enhance the hold, being wanted is such a design on the casing or shell, and that permitting easy passage of electromagnetic waves to result eventually in the production of radiation outwardly or being encroached upon by external interference. The same actuality prevails and is true as of other coating guides employed on common control interfaces, including, for example, switching elements, pushkey elements, electric power to acoustic power converters, acoustic power to electric power converters, electric power to optic power converters, or optic power to electric power converters, etc.

SUMMARY OF THE INVENTION

The primary object of the invention is to provide a design of Conductor Coupling or Control Interface incorporating a convexo-concave coupling labyrinth separator for separation from electromagnetic waves, comprising essentially coated components or coating guides such as conductor or control interface, insulator and closed (core filled) type or web-form, multiple-holed (hollow-set) one-piece or assemblage coated components made from metal or other electromagnetic wave-insulating materials; with one or more section of said coated component treated bent, or arched, or notched semicircularly, or elbow-bent, or obliquely bent, in a largely labyrinthine geometry, to be matched with suitable insulator to form insulation, thence coupled by means of coupling or metal on the body of the control interface itself, or alternatively coating shell produced from other electromagnetic wave-insulating materials, or still directly to ad hoc matching metal or the Main Unit Casing made from otherwise electromagnetic wave-insulating materials to form a tight coupling, it being in addition configured so as to assure mutual shielding effect, realized in a convexo-concave coupling/segregation labyrinth meant for and serving the purpose of a barrier to electromagnetic penetration, featuring tensile strength and reassured protection against deviation leakage, as well as inroad intrusion of electromagnetic waves. A convexo-concave coupling/segregation labyrinth design for an electromagnetic wave barrier structure as such may be further adapted to the intake/outlet port of the Casing to furnish said port with electromagnetic wave barrier effects in addition to serving the purpose of heat diffusion through ventilation.

BRIEF DESCRIPTION OF THE DRAWINGS

FIG. 10 is a cross-section of the invention embodied so that the coated components are all planted in a same orientation;

FIG. 11 is a partially taken cross-section of the three-dimensional assembly shown in FIG. 10;

FIG. 12 is a cross-section of the invention embodied such that the coated components are planted for assemblage in more than one symmetrical orientations;

FIG. 13 is a cross-section of a further execution wherein the embodiment is such that the coated components are planted for assemblage in more than one symmetrical orientations;

FIG. 14 is a partially taken cross-section of the three-dimensional assembly shown in FIG. 13;

FIG. 15 is a cross-section of the invention embodied such that a single coated component is planted unilaterally for assemblage;

FIG. 16 is a partially taken cross-section of the three-dimensional assembly shown in FIG. 15;

FIG. 17 is a cross-section of the assembly wherein a coated element is planted trapezoidally; pursuant to the invention;

FIG. 18 is a cross-section of an assembly wherein the coated element is planted multiply in a same, trapezoidal orientation;

FIG. 19 is a partially taken cross-section of the three-dimensional assembly shown in FIG. 18;

FIG. 20 is a three-dimensional view of a coated component laid out in multiple side by side assembly, prosecuted according to the invention;

FIG. 21 is a cross-section of a coated component being planted in a wave pattern assembly, according to the invention;

FIG. 22 is a cross-section of the coated component being planted singly or doubly in a wavy configuration, according to the invention;

FIG. 23 is a cross-section of the coated component being planted in sinusoidal pattern for assembly, according to the invention;

FIG. 24 is a cross-section of the coated component being planted singly or doubly in sinusoidal pattern in a same orientation, for assemblage according to the invention;

FIG. 24A is a cross-section of a coated component being helicoidally planted for assemblage in a three-dimensional setting according to the invention;

FIG. 25 is a cross-section of a coated component having a semicircular convex profile, assembled according to the invention;

FIG. 26 is a cross-section of a coated component having a semicircular convex profile, and planted multiply in a same orientation according to the invention;

FIG. 27 is a cross-section of a coated component having a semicircular convex profile, planted interwovenly in a multiple execution, assembled according to the invention;

FIG. 30 through FIG. 41 illustrate altogether the invention executed such that the coated components are embodied to be of a socket unit;

FIG. 42 through FIG. 47 illustrate the invention such that the coated components are executed to be planted in a common orientation or in symmetric array, assembled accordingly;

FIG. 48 illustrates the invention executed as a male socket as applied in an insert type conductor;

FIG. 49 illustrates the invention executed as a female socket as applied in an insert type conductor;

FIG. 50 illustrates the invention executed to be sort of a transfer connector with one end forming a plug, another end, a socket;

FIG. 51 and FIG. 52 illustrate the invention executed to be a nut-locking type plug;

FIG. 53 and FIG. 54 illustrate the invention executed to be a nut-locking type plug, in a variant embodiment;

FIG. 55 illustrates the invention as applied to be a plug type earphone set or something akin to a conductor interface;

FIG. 56 illustrates the invention embodied as a socket type earphone set or something akin to a conductor interface;

FIG. 57 is an analytical three-dimensional view of the invention embodied as an insertion pin type circuit board;

FIG. 58 illustrates a further embodiment of the invention as an insertion pin type circuit board;

FIG. 59 illustrates still another example of the invention embodied as an insertion pin type circuit board;

FIG. 60 illustrates the invention by virtue of its labyrinth electromagnetic wave barrier structure as applied on pushkey components of other control interface, shown in cross-section;

FIG. 61 illustrates the invention by virtue of its labyrinth electromagnetic wave barrier structure as applied in a further example onto pushkey components of another control interface, shown in cross-section;

FIG. 62 illustrates the invention by virtue of its labyrinth electromagnetic wave barrier structure as applied to a single row of coated wire, shown in a lateral view;

FIG. 63 illustrates the invention by virtue of its labyrinth electromagnetic wave barrier structure as applied to a single row of coated wire, shown in a top view;

FIG. 64 illustrates the invention by virtue of its labyrinth electromagnetic wave barrier structure as applied to juxtaposed coated wire, shown in a lateral profile;

FIG. 65 illustrates the invention by virtue of its labyrinth electromagnetic wave barrier structure as applied to juxtaposed coated wire, shown in a top view;

FIG. 66 illustrates the invention by virtue of its labyrinth electromagnetic wave barrier structure as applied to printing technology whereby the coated wire is executed to be soft type, shown in a side view; and FIG. 67 illustrates the invention by virtue of its labyrinth electromagnetic wave barrier structure as applied to printing technology, whereby the coated wire is executed to be of a soft type, shown in a three-dimensional setting.

DETAILED DESCRIPTION OF THE PREFERRED EMBODIMENTS

Figure 1:
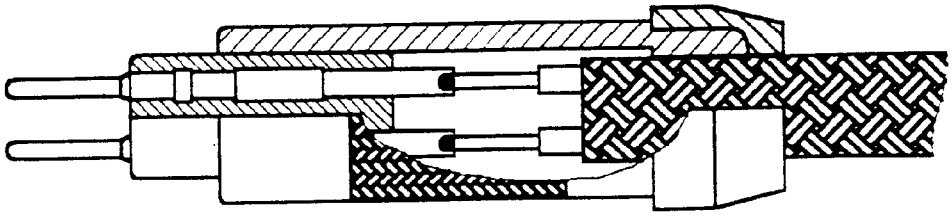
FIG. 1 PRIOR ART
FIG. 1 is a cross-section of the male form of a conductor or control interface, assembled to form, according to a prior art.
Figure 2:
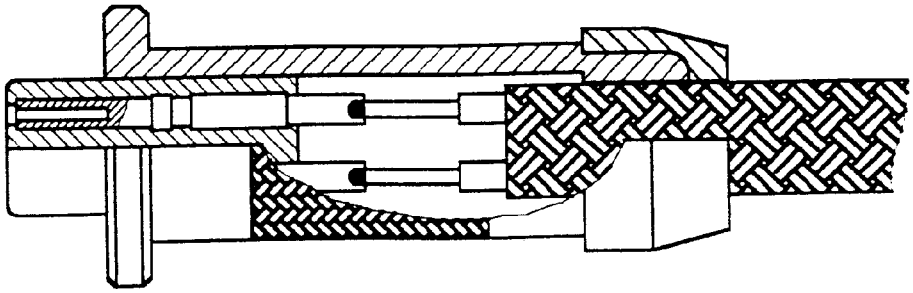
FIG. 2 PRIOR ART
FIG. 2 is a cross-section of the female form of a conductor or control interface assembled to form, according to a prior art.
Figure 3:
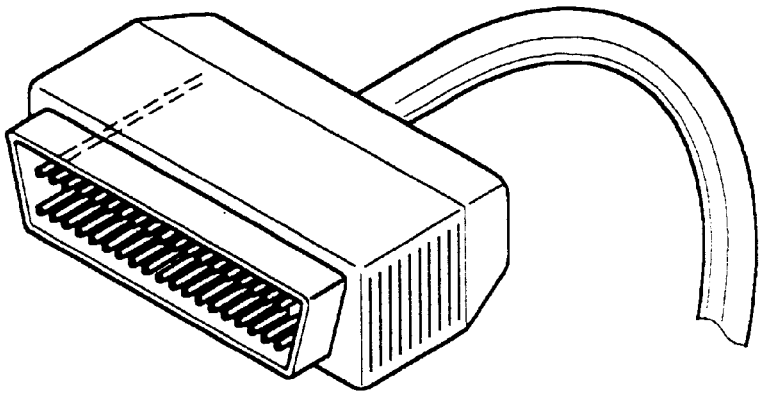
FIG. 3 PRIOR ART
FIG. 3 is a three-dimensional perspective of a male form of Connection Module, a prior art.
Figure 4:
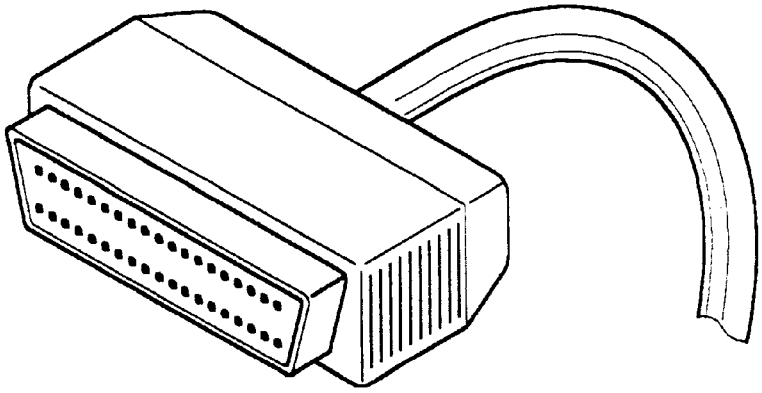
FIG. 4 PRIOR ART
FIG. 4 is a three-dimensional perspective of a female form Connection Module, a prior art.
Figure 5:
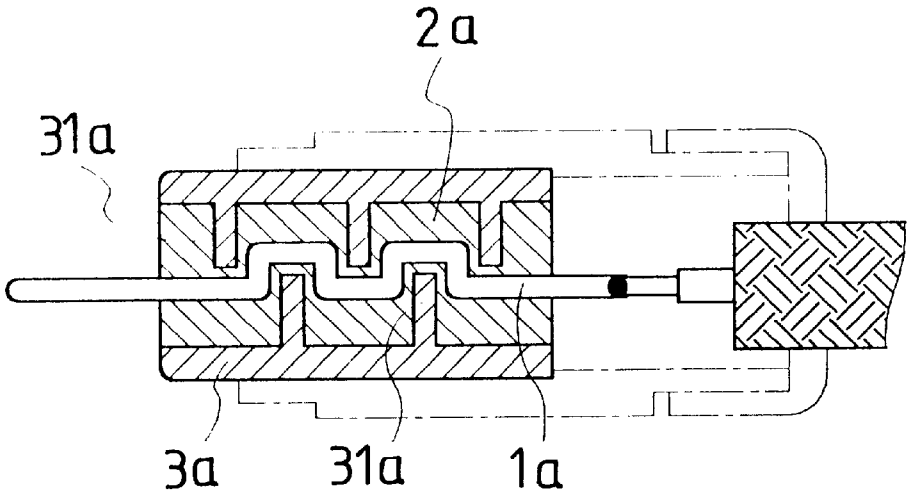
FIG. 5 is a three-dimensional cross-section of a first embodiment according to the invention.
Figure 6:
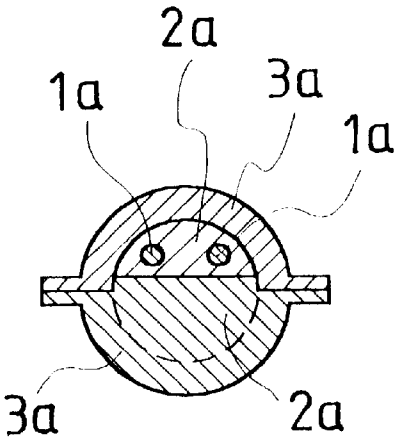
FIG. 6 is a longitudinal cross-section of a first embodiment according to the invention.

Referring to FIG. 5 and FIG. 6, it will be seen that the invention titled Conductor Coupling or Control Interface incorporating a convexo-concave coupling labyrinth separator for insulation of electromagnetic waves comprises essentially: component 1*a* applied with a coating for conduction or as a control interface, insulator 2*a,* coating element composed of closed (core filled) or multiple holed (hollow-set) metal or otherwise electromagnetic wave insulant materials, executed in one-piece structure or assembled to form, a casing 3*a;* whereof the coated component 1*a* can serve the purpose of a conductor pin or contact as part of a plug or socket assembly, a switching element for a control interface, or else a pushkey element, an electric energy to acoustic power device, a speaker, for example, an acoustic power to electric power device, a microphone, for example, an electric power to optic power device, a lamp or display, for example, or still an optic energy to electric power device, a solar board, for example, for execution, the coated component 1*a* shall be of a labyrinthine geometry comprising one or more section of curved, annularly concave or annularly convexo configuration, or alternatively treated in a bent elbow or obliquely bent, to be matched with a suitable insulator 2*a* to form a barrier, to be thence securely bound to the coupling or the metal part of the control interface per se, or a casing 3*a* made of otherwise electromagnetic wave insulant material, or alternatively bound directly to metal adaptors provided ad hoc or otherwise main casing made of otherwise material impervious to electromagnetic wave penetration, of mutually shielding geometry to make a convexo-concave inlay serving as a labyrinthine electromagnetic wave barrier structure, the casing 3*a* made from said metal or otherwise material impervious to electromagnetic penetration being circular, square, or otherwise shaped, one-piece or a combination of separate fragments, or alternatively integral with the metal body or the main shell casing made from otherwise material impervious to electromagnetic penetration, in respect of which holding strength is ensured by engaging convexities 31*a* configured in a mutually shielding manner within, in the form of either closed core filled mass or retiform or beehive, thus forming a realization of the invention Conductor Coupling or Control Interface incorporating a convexo-concave coupling labyrinth separator for separation from Electromagnetic Waves.

Figure 7:
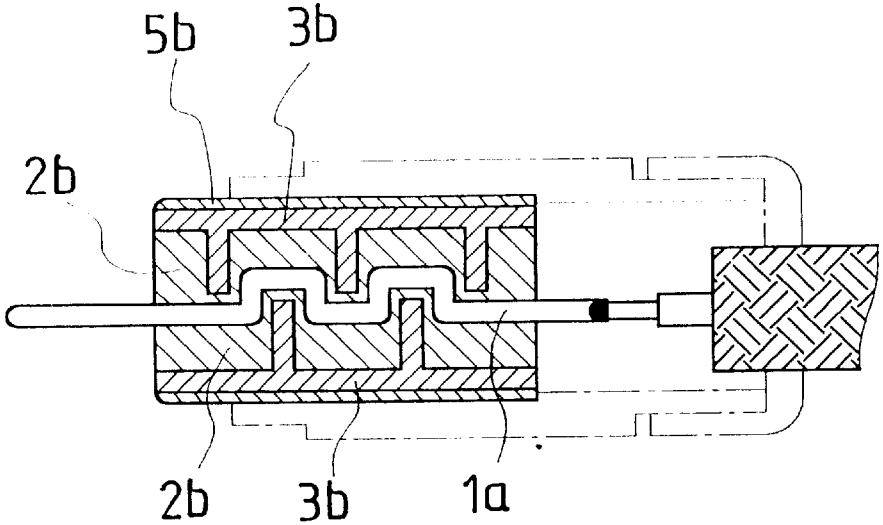
FIG. 7 is a cross-section of a second embodiment of the invention incorporating additionally a coupling means to form a thrust coupling union.
Figure 9:
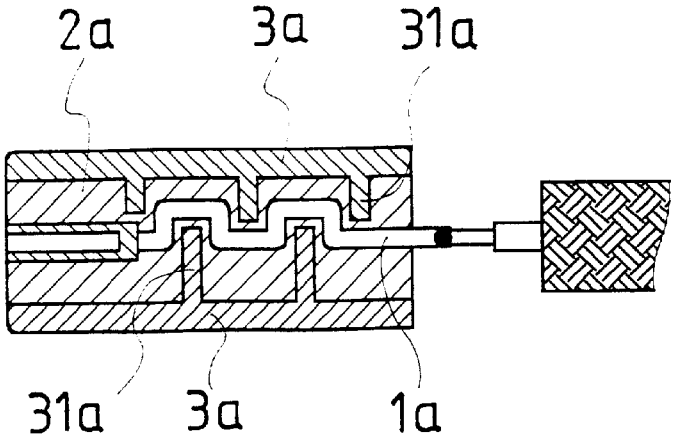
FIG. 9 is a cross-section of the invention embodied as a female conductor or control interface.
Figure 1:
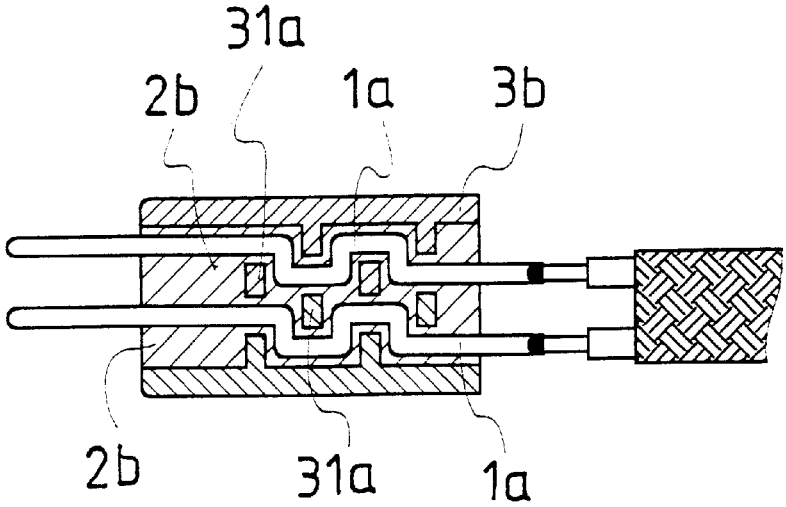
Figure 1:
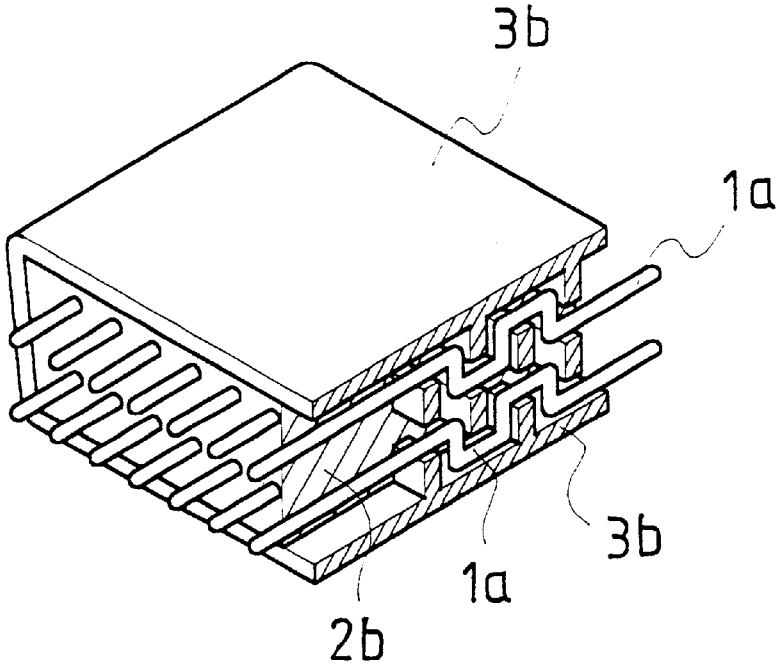
Figure 1:
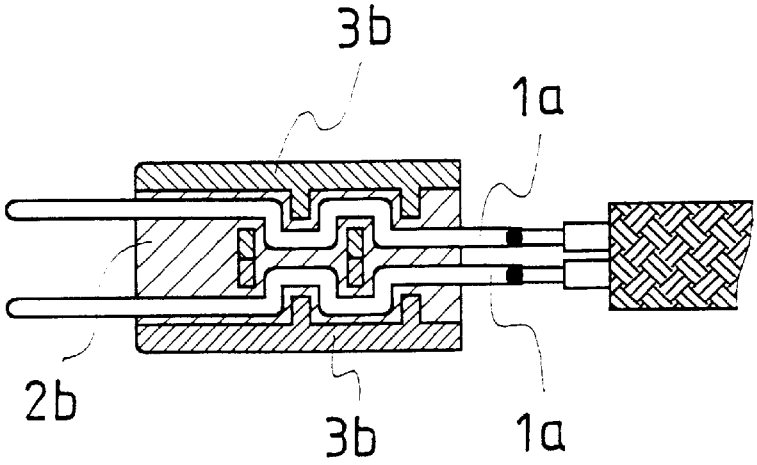
Figure 1:
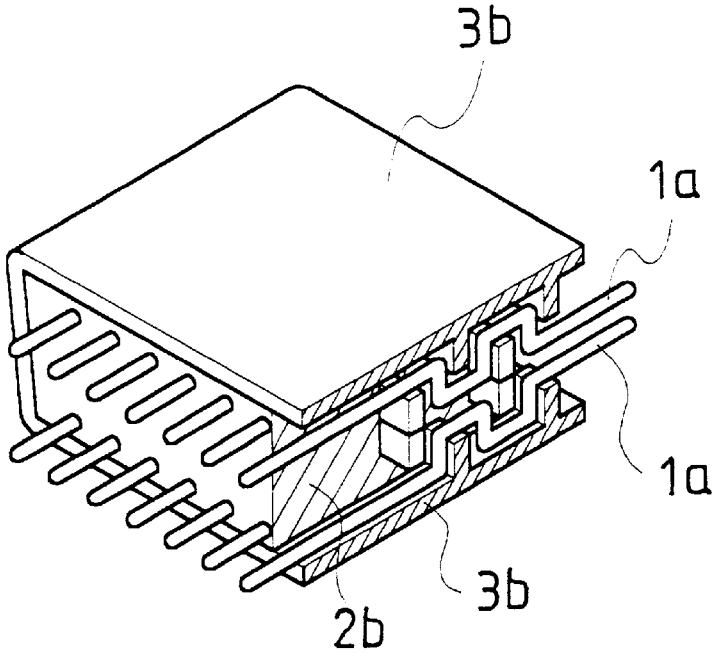
Figure 1:
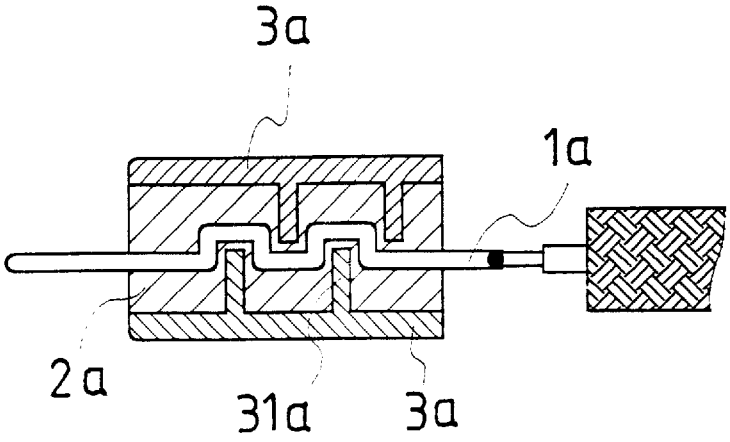
Figure 1:
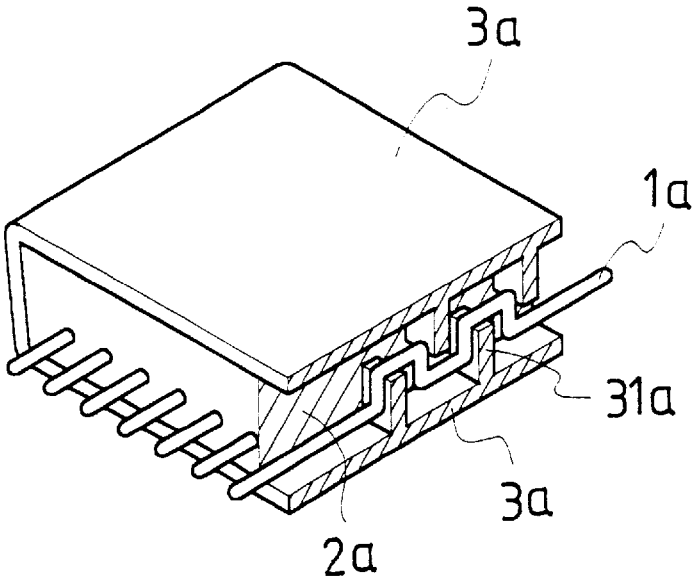
Figure 1:
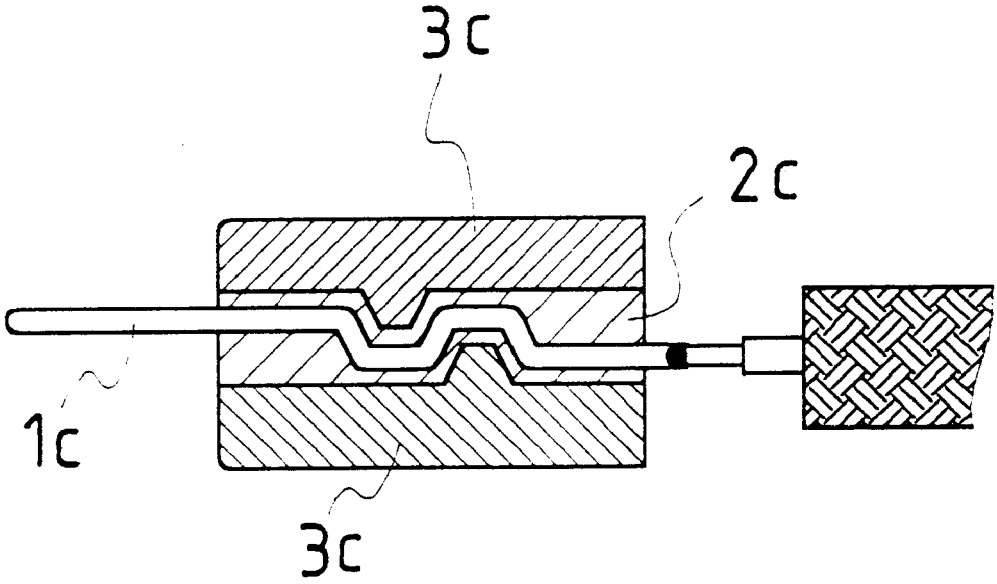
Figure 1:
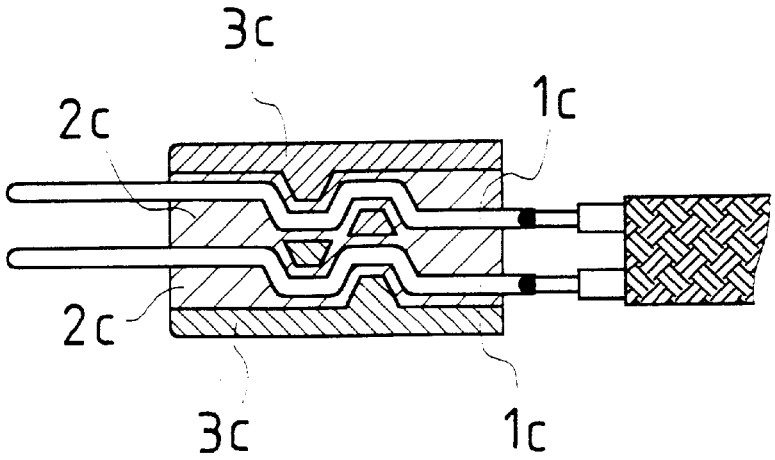
Figure 1:
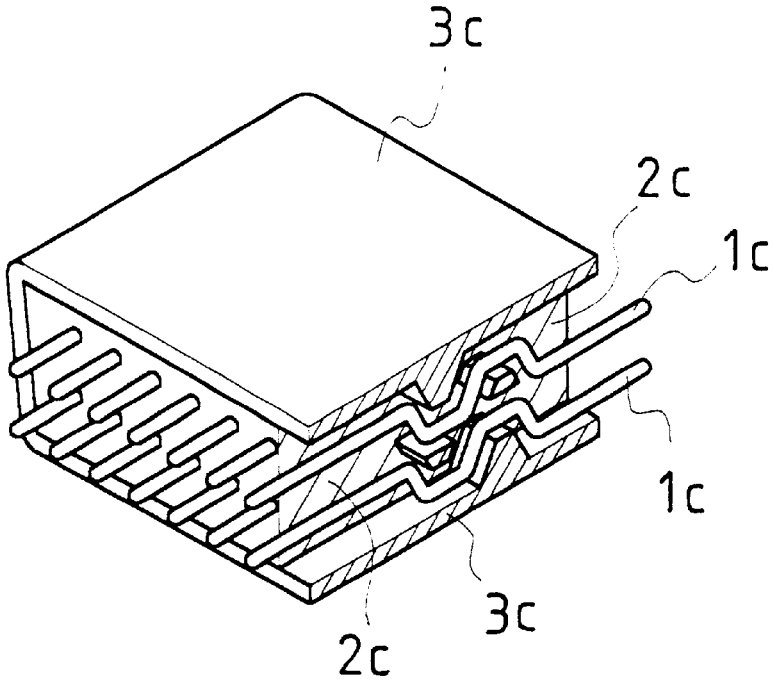
Figure 2:
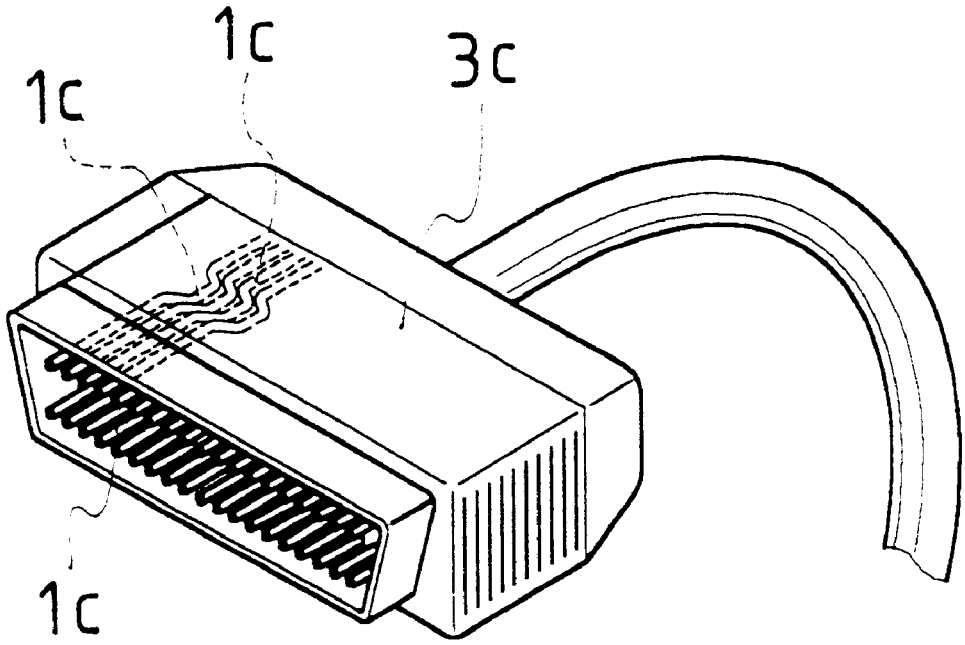
Figure 2:
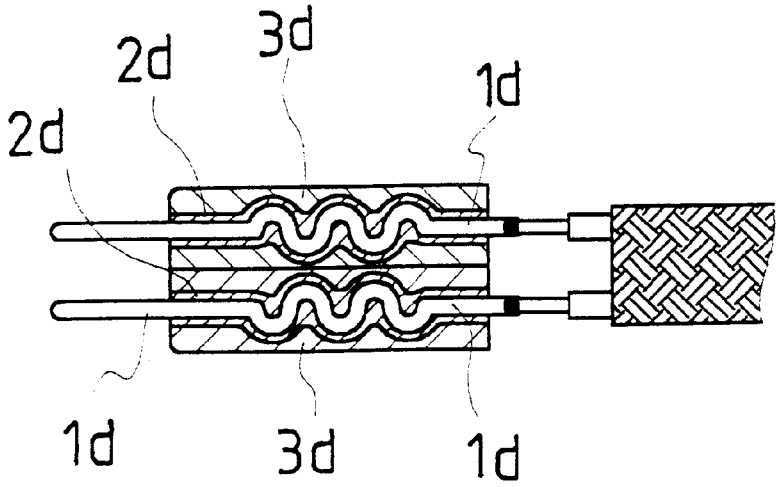
Figure 2:
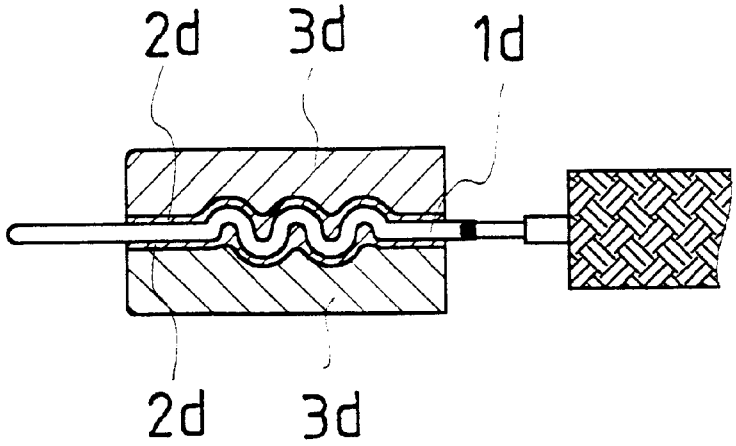
Figure 2:
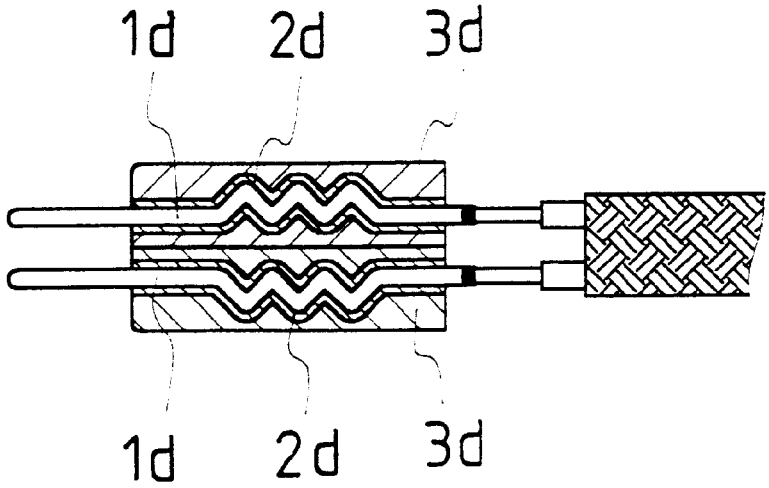
Figure 2:
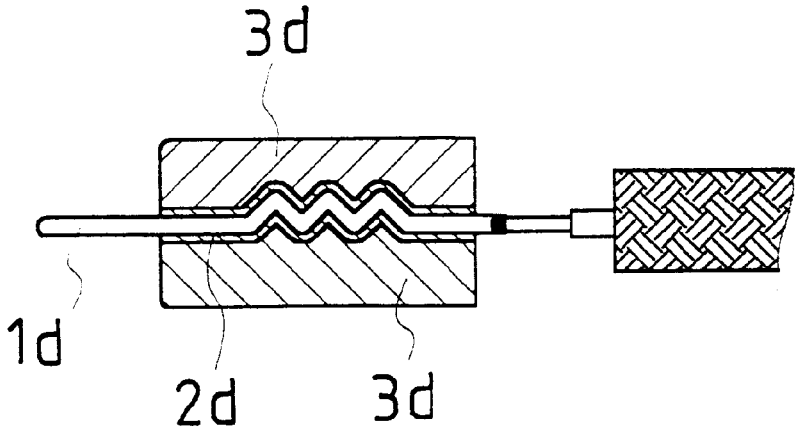
Figure 2:
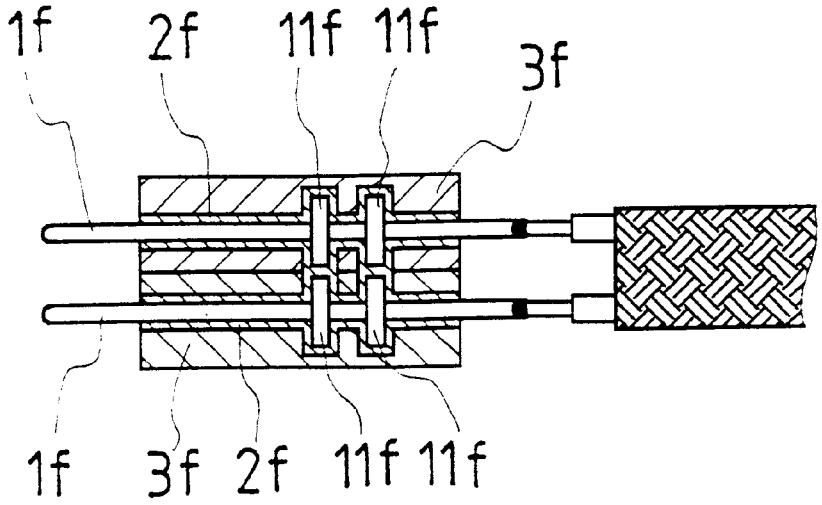
Figure 2:
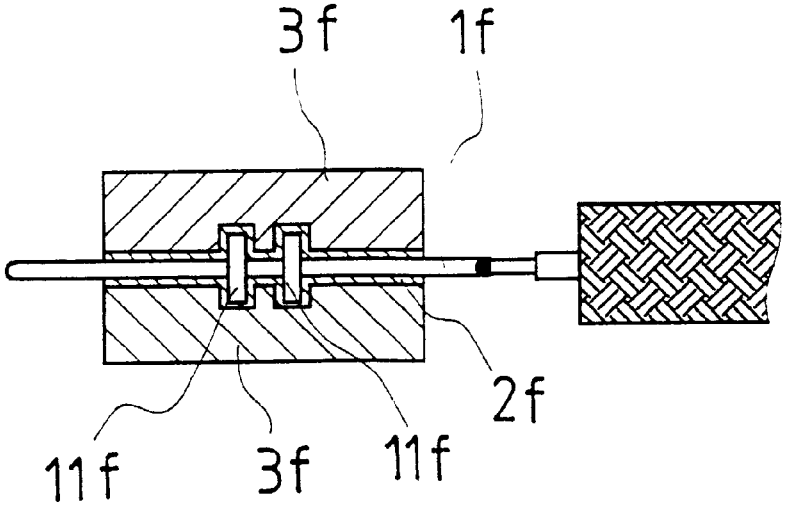
Figure 2:
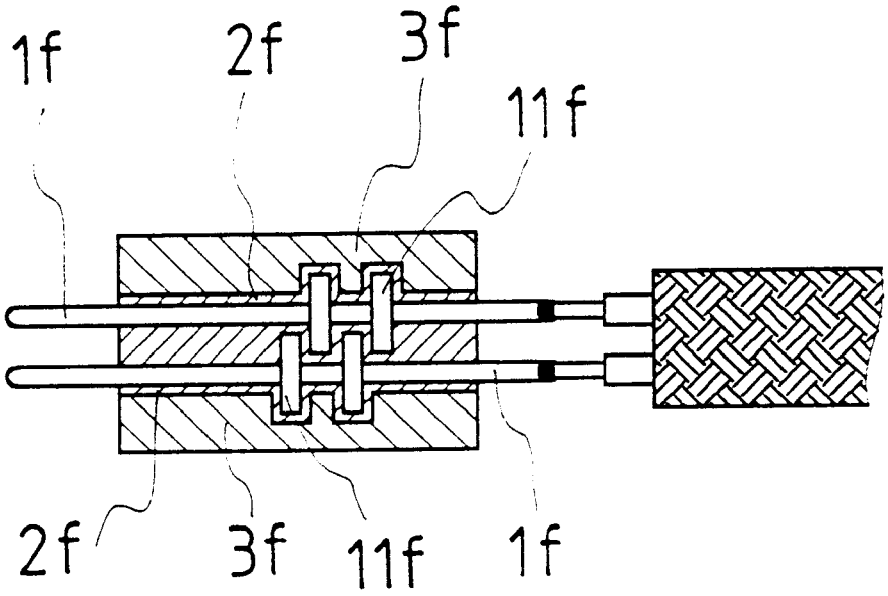

In the embodiment described in the last paragraph, said coated component 1*a* can be a conductor pin or contact of a plug or socket, to be eventually coupled to wire, leader component, and overlaid with an integrally bound insulator 2*a* or a casing 3*a* which is metal or made from otherwise material impervious to electromagnetic penetration, such as that shown in FIG. 7, meant for execution into a plug or socket assembly as that exemplified in FIG. 9.

Figure 8:
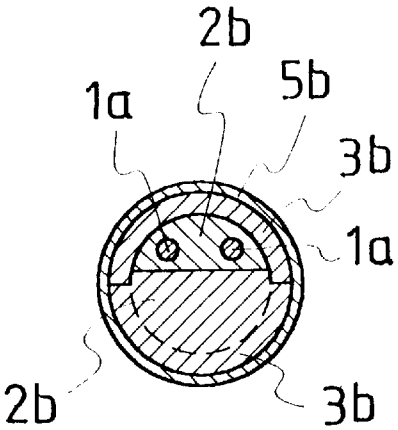
FIG. 8 is a longitudinal cross-section of a second embodiment according to the invention.
Figure 1:
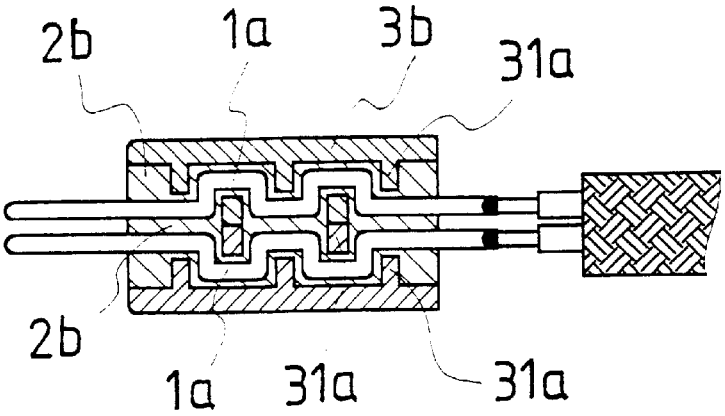

Binding of the casing 3*a* which is made of metal or otherwise material impervious to electromagnetic penetration to the coated component 1*a,* insulator 2*a* is executed in a structure permissive of upper lid/lower lid separation, firstly engaged, then locked tight, like what is shown in FIG. 5 and FIG. 6;

Or as shown in the examples of FIG. 7 and FIG. 8, the structure which is integrally one-piece or separable assembly, of a casing 3*b* made of metal or otherwise material impervious to electromagnetic penetration may further form a compression union with a sleeving component 5*b* while the coated component 1*b* therein is planted in a same orientation (FIG. 10, FIG. 11), or in opposite symmetry (FIG. 12, FIG. 13, FIG. 14), in a single or plural implementation, with insulator 2*b* applied in-between, to consummate a labyrinthine electromagnetic barrier structure characterized by convexo-concave isolation.

Also, as disclosed in the foregoing embodiment, by having the planting of said coated component 1*b* executed in a double layered or multiple layered vertically arrayed or traversely arrayed layout, such as those shown in FIG. 18 through FIG. 20, or alternatively in just a single layered layout, such as those shown in FIG. 15 through FIG. 17, and that reinforced with an insulator 2*b* for isolation, which furthermore, is coupled to metal 3*b* that is the control interface itself or a coating shell made from otherwise material impervious to electromagnetic penetration or directly to ad hoc metal or the Main Unit casing made from otherwise material impervious to electromagnetic penetration to form a secured coupling, thus realizing a convexo-concave mutually shielding coupling/barrier labyrinth serving the purpose of isolation of electromagnetic penetration.

Figure 29:
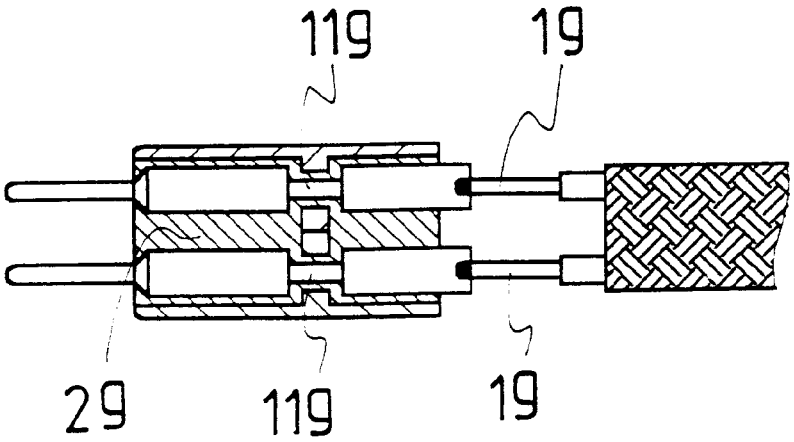
FIG. 29 is a cross-section of a coated component having a semicircular concave profile, being planted multiply in a same orientation.
Figure 28:
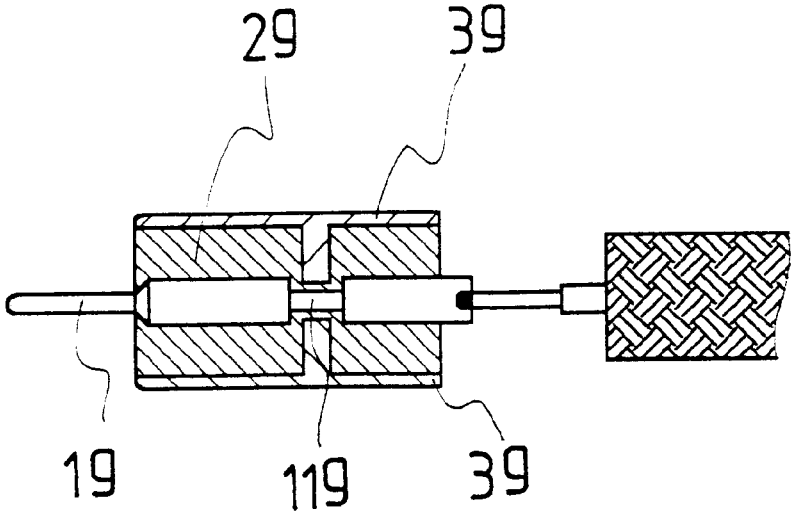
FIG. 28 is a cross-section of a coated component having a semicircular concave profile, assembled according to the invention.
Figure 3:
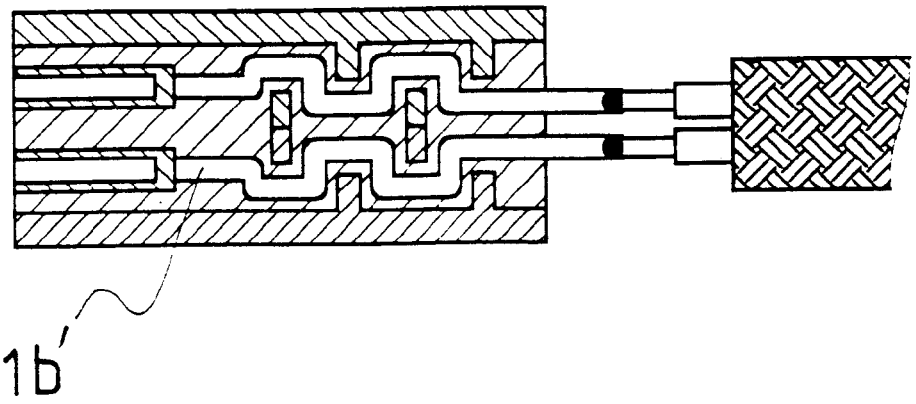
Figure 3:
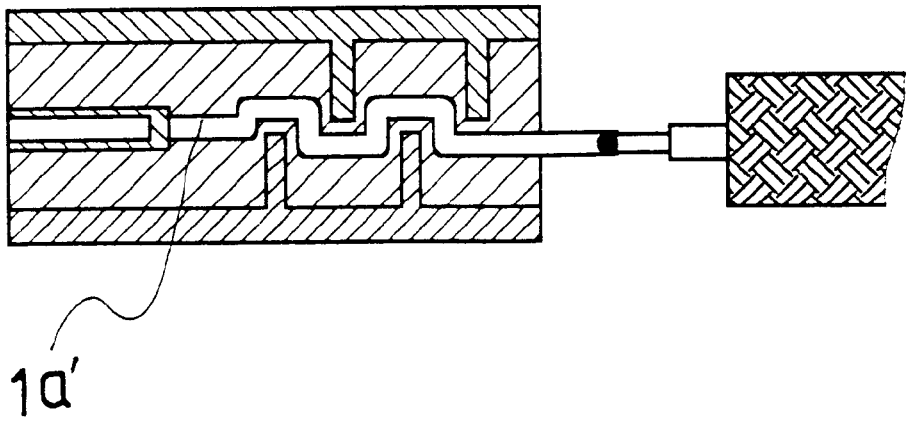
Figure 3:
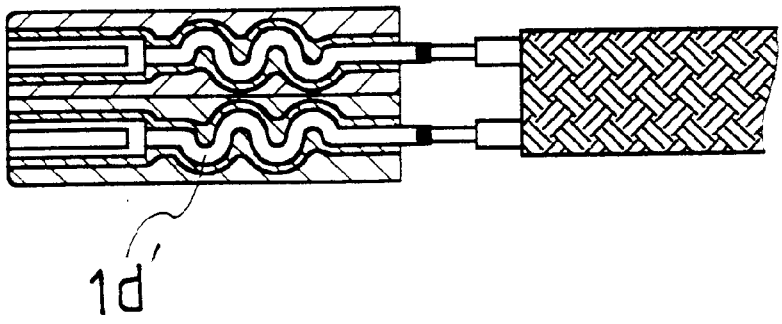
Figure 3:
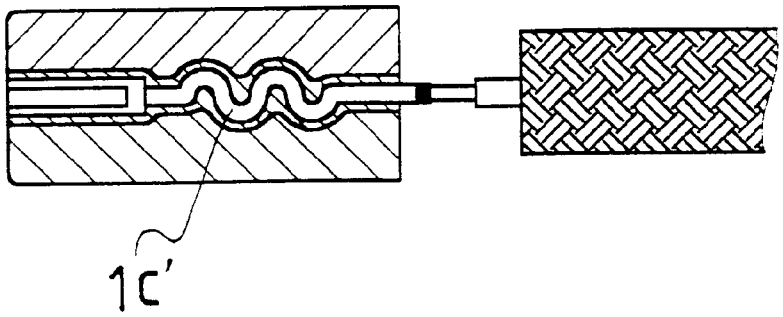
Figure 3:
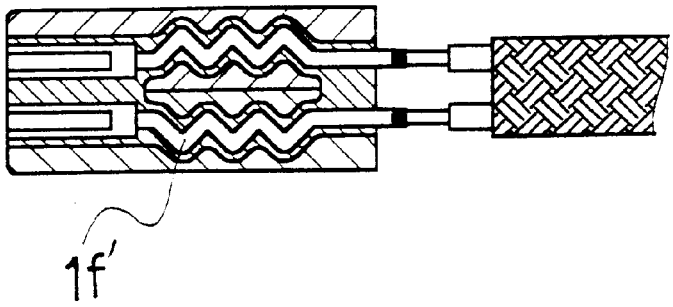
Figure 3:
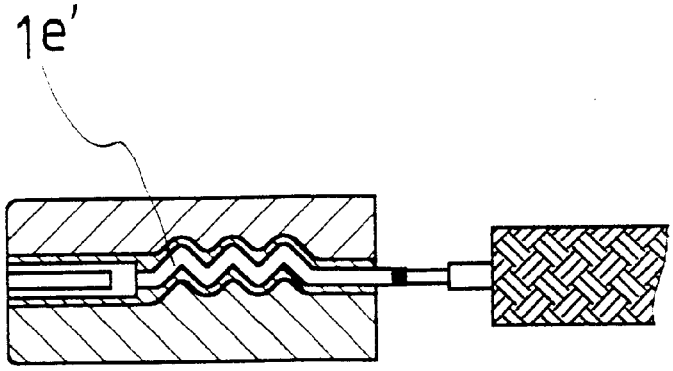
Figure 3:
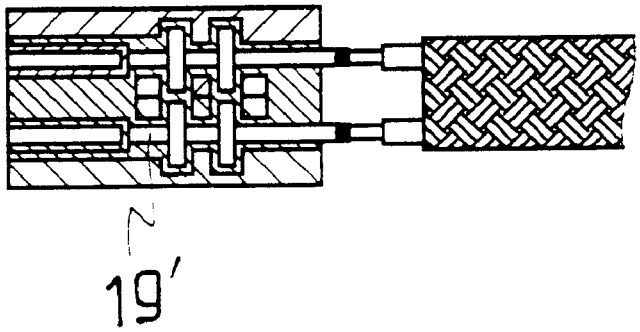
Figure 3:
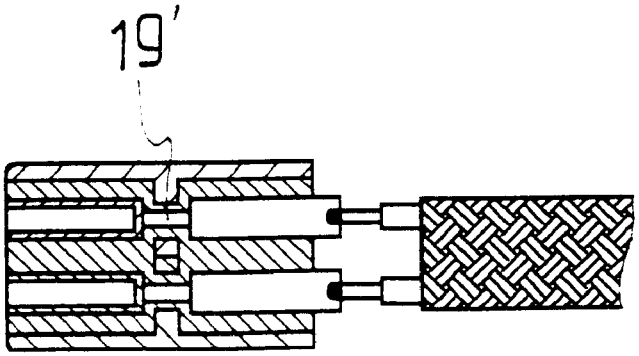
Figure 3:
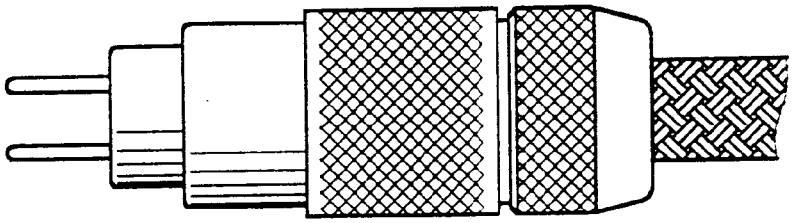
Figure 3:
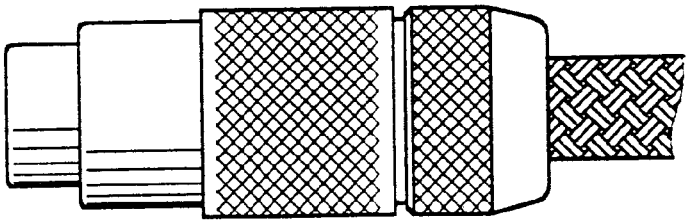
Figure 4:
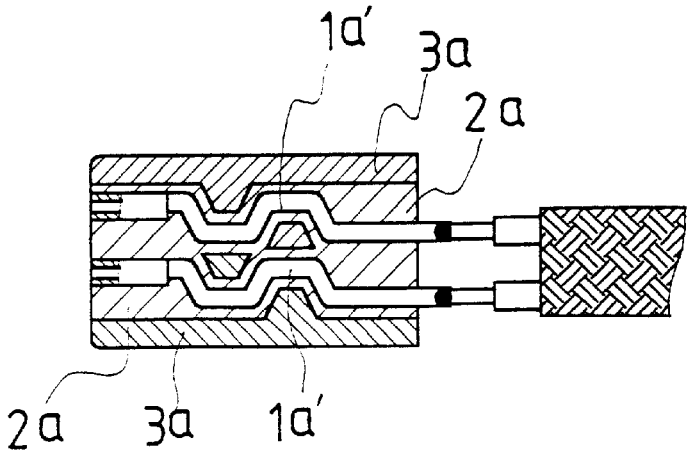
Figure 4:
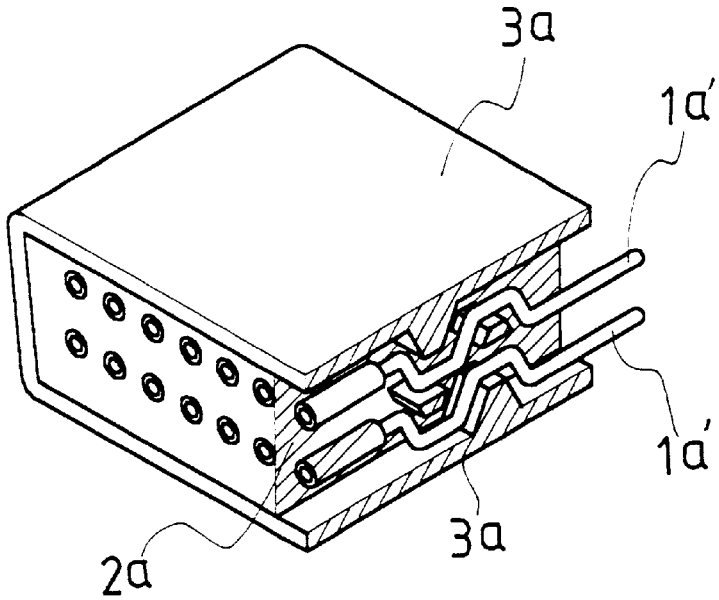
Figure 4:
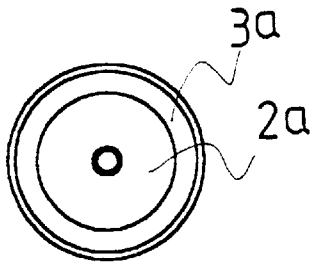
Figure 4:
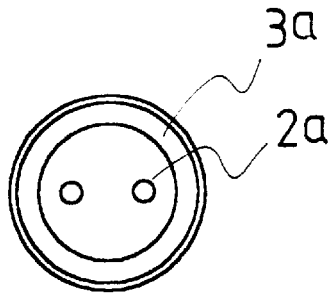
Figure 4:
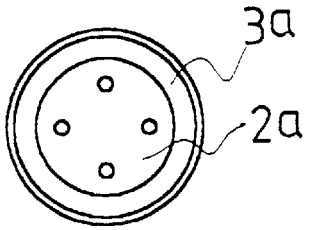
Figure 4:
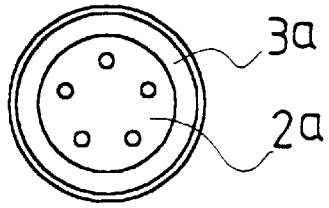
Figure 4:
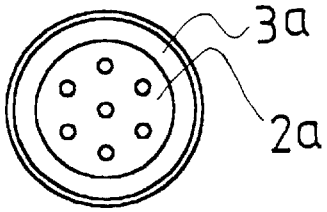
Figure 4:
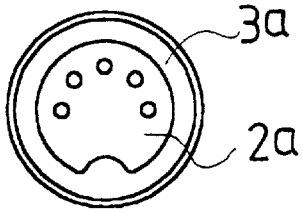
Figure 4:
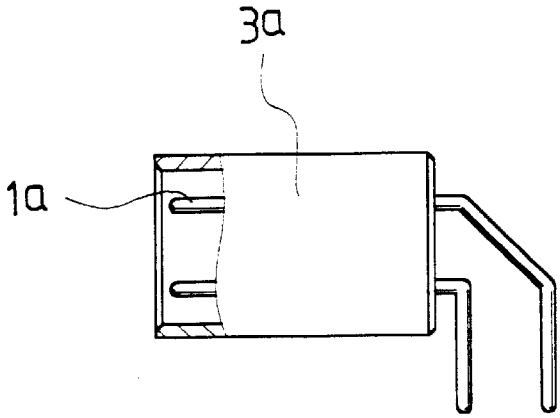
Figure 4:
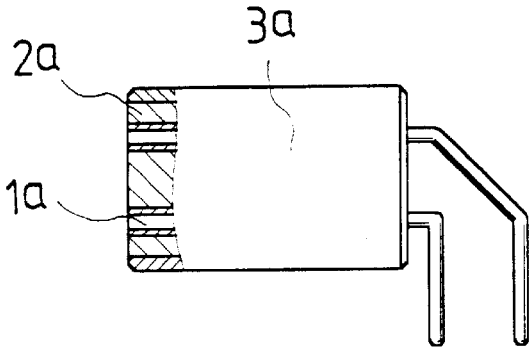
Figure 5:
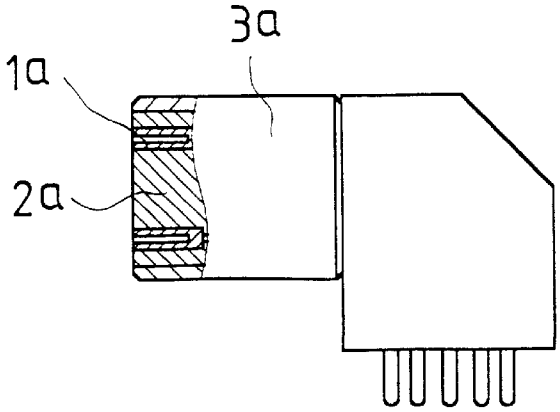
Figure 5:
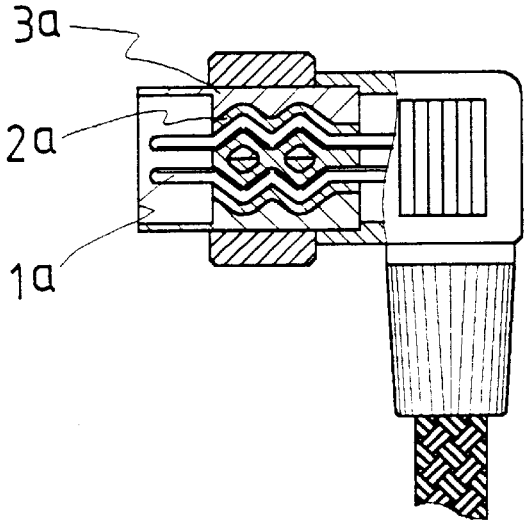
Figure 5:
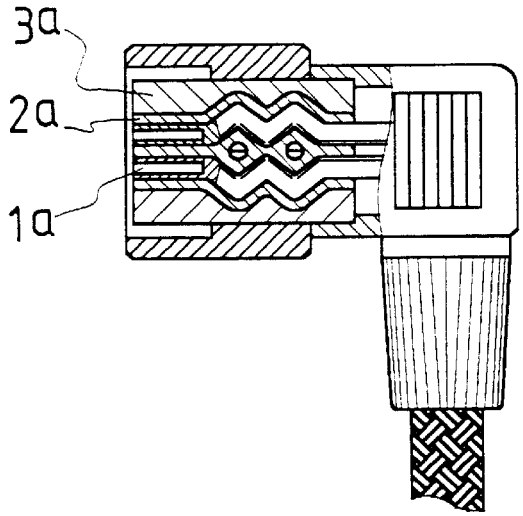
Figure 5:
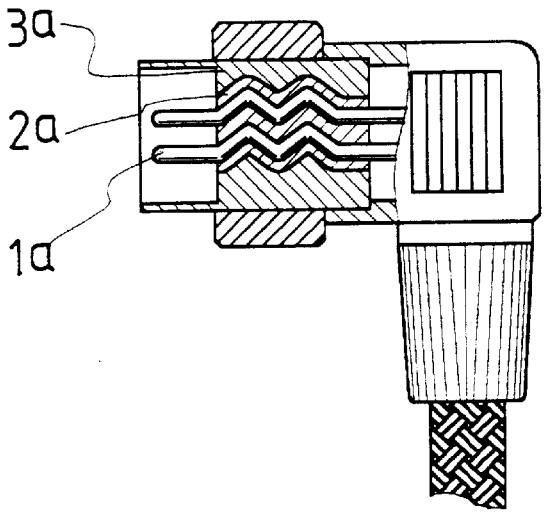
Figure 5:
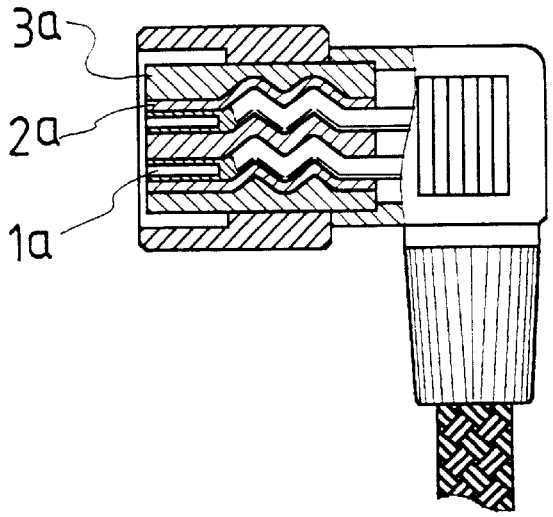
Figure 5:
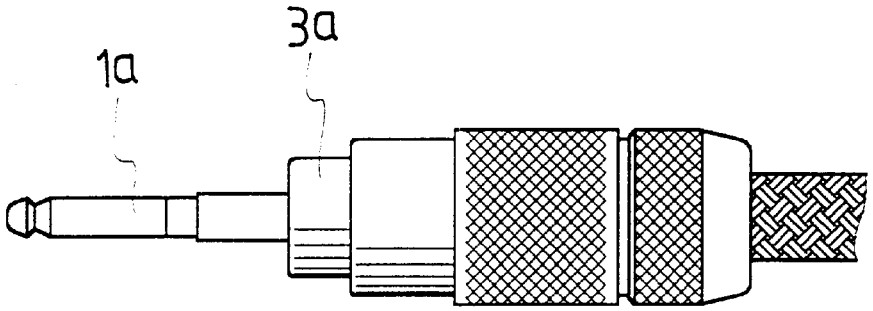
Figure 5:
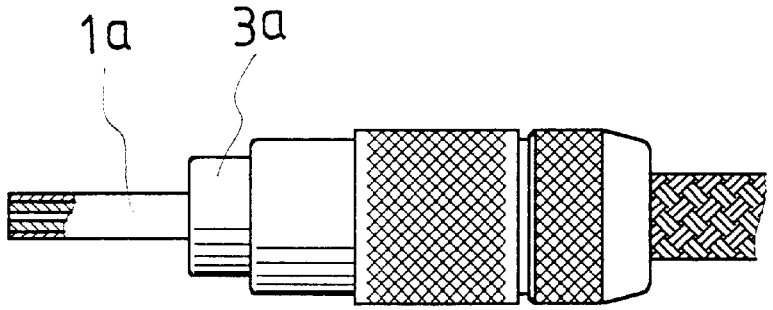
Figure 5:
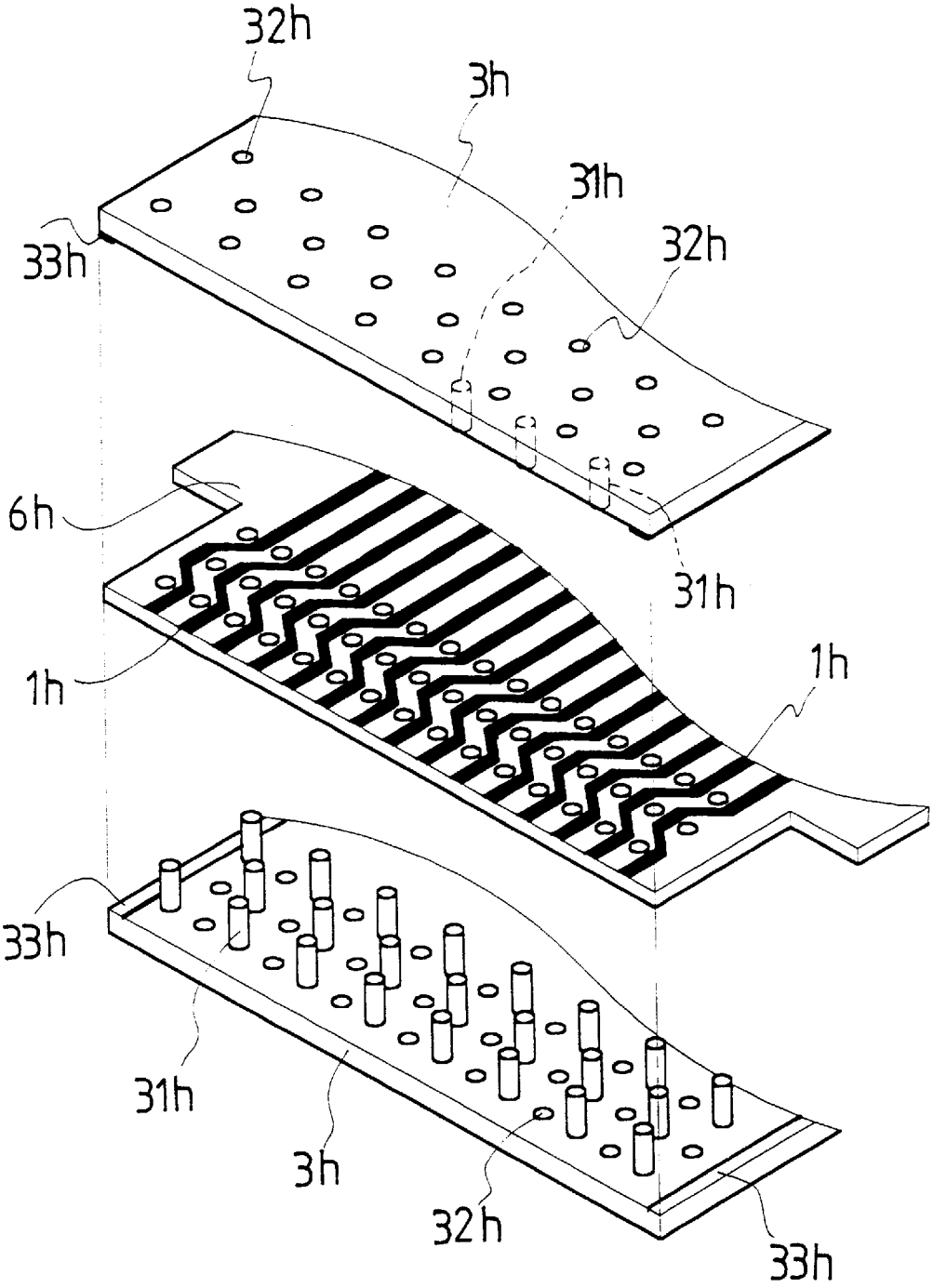
Figure 5:
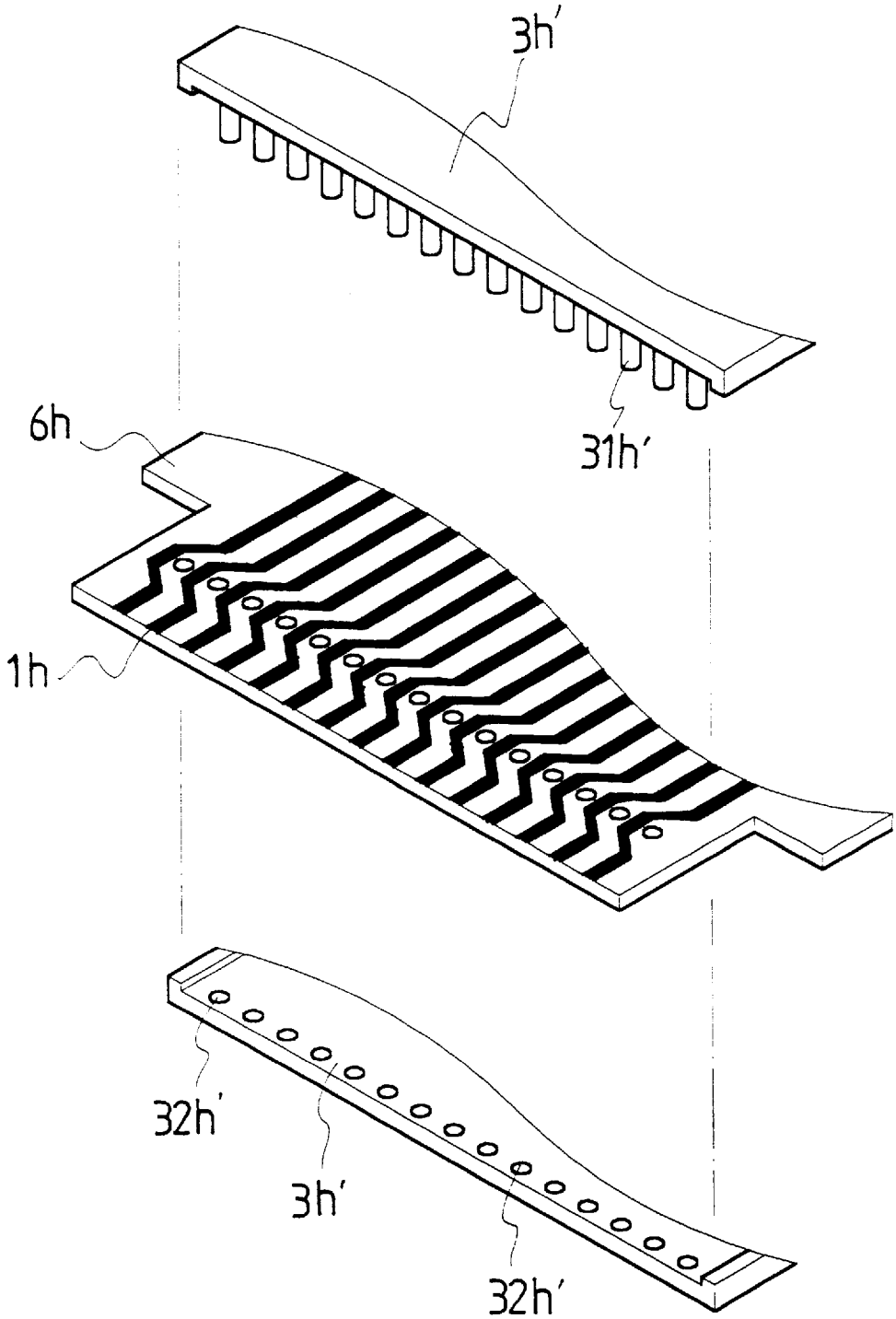
Figure 5:
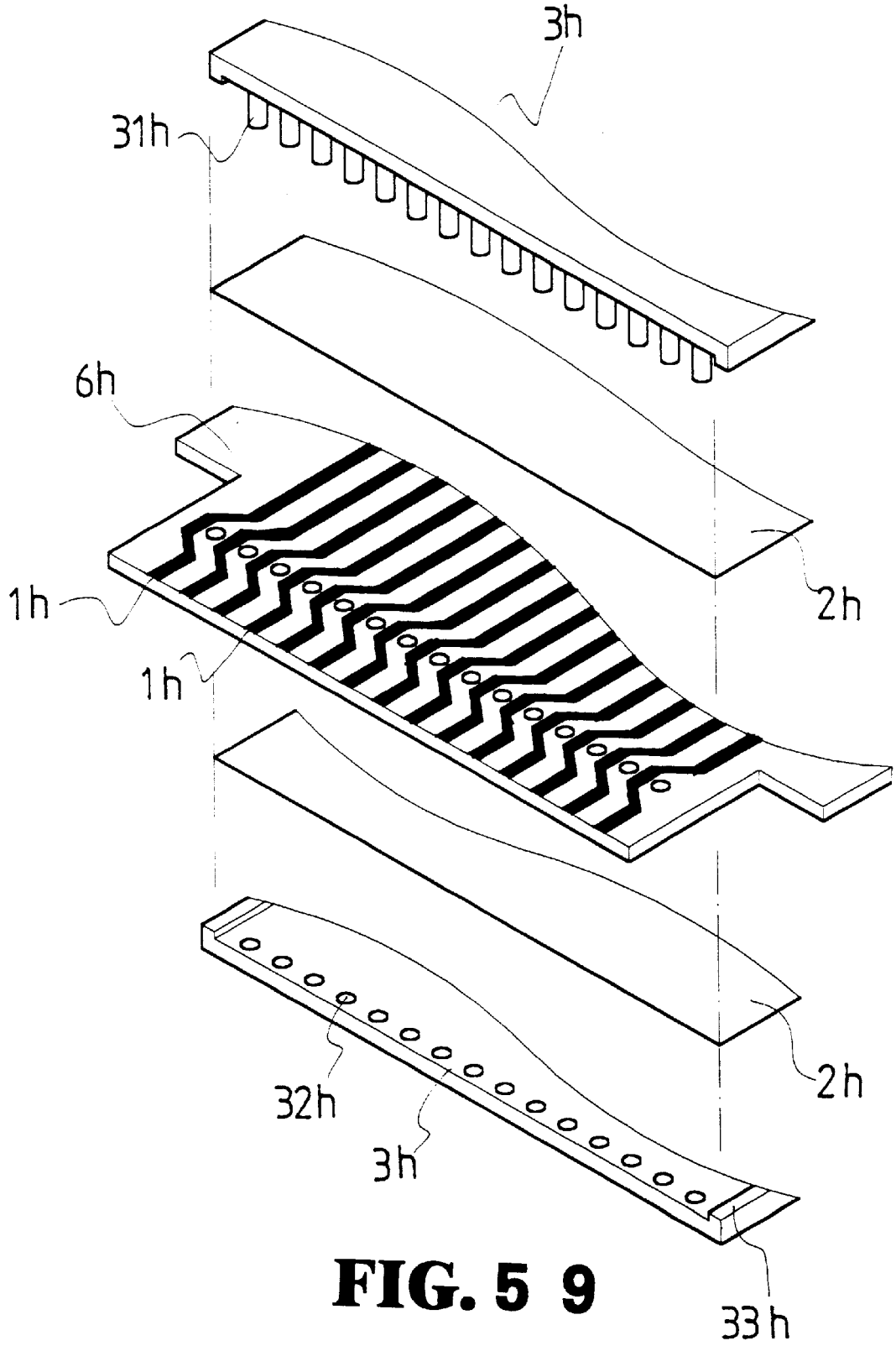
Figure 6:
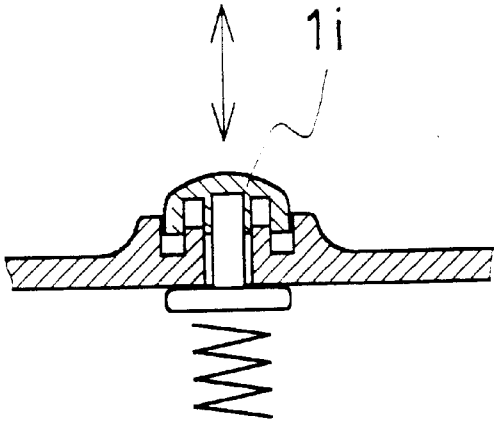
Figure 6:
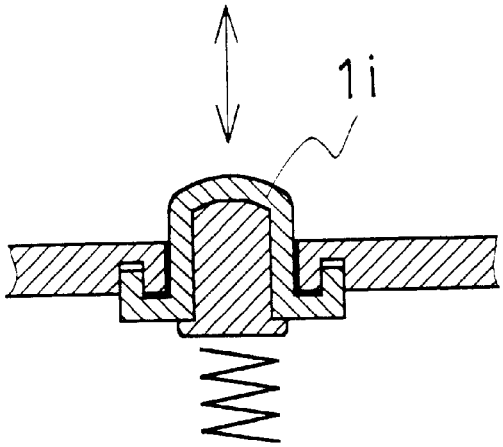
Figure 6:
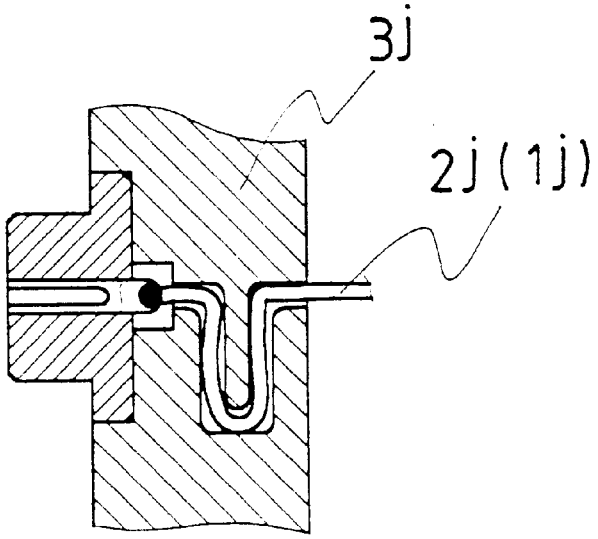
Figure 6:
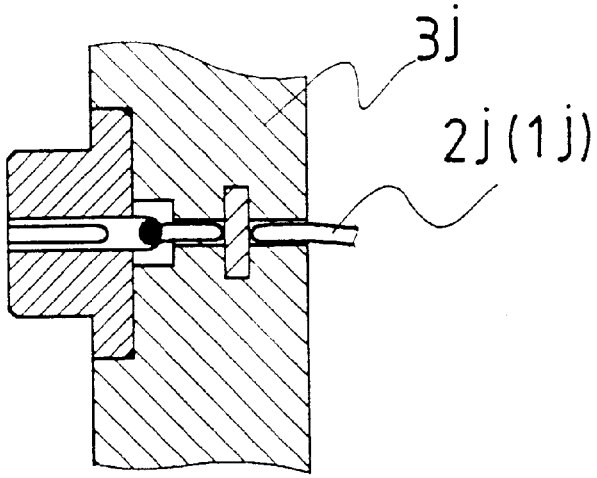
Figure 6:
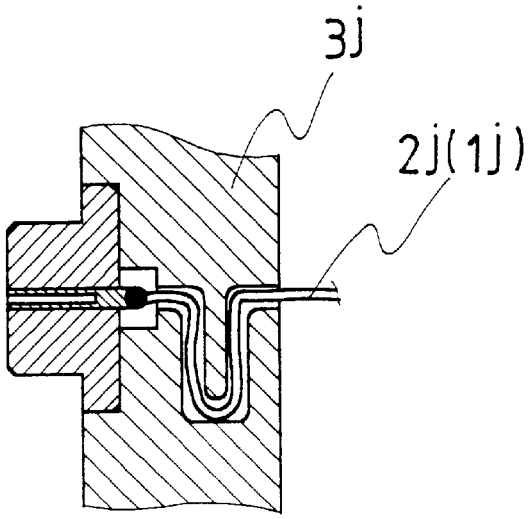
Figure 6:
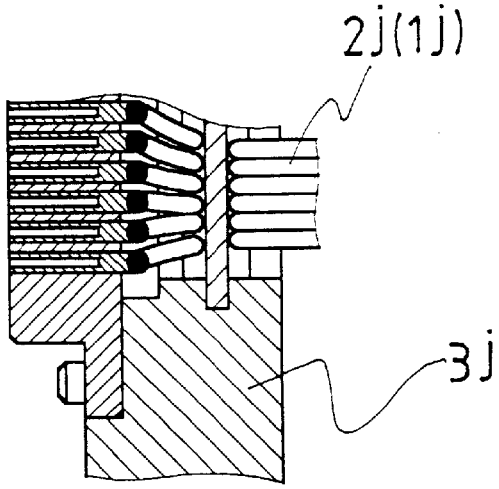
Figure 6:
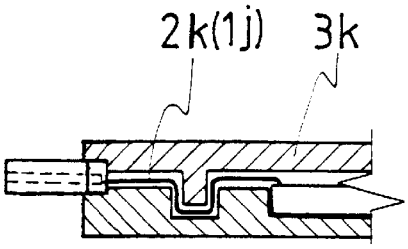
Figure 6:
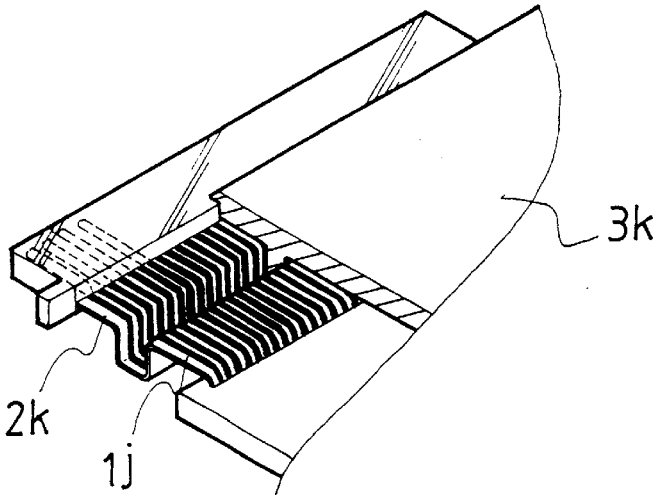

As shown in FIG. 17, FIG. 18 and FIG. 19, said coated component 1*c* is treated such that one or more section thereof is processed to bear a labyrinthine geometry, curved trapezoidally, for example, to shorten the diameter of the casing 3*c* which is made of metal of a symmetrically complementary geometry or otherwise material impervious to electromagnetic penetration, so that the overall assembly benefits from size compactness, that, in combination with insulator 2*c* or metal or a casing 3*c* made from otherwise material impervious to electromagnetic penetration, forms a convexo-concave labyrinthine barrier to electromagnetic transmission, configured in geometric symmetry;

In a similar manner, in the examples shown in FIG. 21, FIG. 22, or FIG. 23, FIG. 24, FIG. 24A, the coated component 1*d* is treated such that one or more section thereof is processed to bear a labyrinthine geometry, or alternatively a wavy form, entirely or partly regularly or irregularly curved or serrated contour, permitted configuration including parallel bent or helicoidally three-dimensional, such as is shown in FIG. 24A, likewise, the insulator 2*d,* or metal or casing 3*d* made from otherwise material impervious to electromagnetic penetration may be configured mutually shielding to facilitate coupling engagement, thus forming a convexo-concave labyrinthine structure of a barrier to electromagnetic penetration;

Further, as shown in FIG. 25 through FIG. 27, on one or more section of the coated component 1*f* which bears a given labyrinthine configuration there may bear entirely or partially, annular convexity 11*f,* regularly shaped or otherwise, serving to mutually shielding and match symmetrically shaped insulator 2*f* or metal or casing 3*f* made of otherwise material impervious to electromagnetic penetration, thus forming the structure of a convexo-concave labyrinthine barrier to electromagnetic penetration;

Again, as shown in FIG. 28, FIG. 29, on one or more section of said coated component 1*g* which bears a given labyrinthine configuration there may bear entirely or partially, annular convexity 11*g,* regularly shaped or otherwise, serving to mutually shield and match symmetrically shaped insulator 2*g* or metal or casing 3*g* made of otherwise material impervious to electromagnetic penetration, thus forming the structure of a convexo-concave labyrinthine barrier to electromagnetic penetration.

Application of said coated component or element pursuant to the invention is not restricted to just plug assemblies, instead the same structure may very well fit for use as a socket assembly too, by referring to FIG. 30 through FIG. 39, it can readily be appreciated that coated components 1*a*', 1*b*', 1*c*', 1*d*', 1*e*', 1*f*', 1*g*' may be adapted to switch from the purpose of a plug to that of a socket all at once. Next, as exemplified in FIG. 40 through FIG. 47, said coated components can be planted in a same orientation or in opposite symmetry, in single or multiple execution, as dictated by a specific purpose of application. By the same token, a coating or covering, one-piece or assembled to form, made from closed, core filled, retiform or porous (hollow-set) metal or otherwise material impervious to electromagnetic penetration, are altogether executable into a convexo-concave labyrinthine structure of a barrier to electromagnetic penetration, specific configuration depending upon the application in question, shown in FIG. 48 is a realization in the form of a male socket for application as an insert type conductor, whereby an insulator 2*a* is applied to wrap up the male coated component 1*a,* followed by covering up with a casing 3*a;* shown in FIG. 49 is a realization of the invention applied to an insert type conductor, to form a female socket, whereby an insulator 2*a* is employed to wrap up the female terminal coated component 1*a,* followed by covering with a casing 3*a,* shown in FIG. 50 is a realization applied to a transfer relay whereof one end is a plug, whereas the other end is a socket, in respect of which the structure of the coated component 1*a,* insulator 2*a* and the casing 3*a* is comparable with those disclosed hereinbefore; shown in FIG. 51 and FIG. 52 are status of the invention applied to a plug which is lockable with a nut, this realization comprises a coated component 1*a* adapted to the male end or to the female end, an insulator 2*a* and a casing 3*a,* the coated component 1*a* being symmetrically aligned; shown in FIG. 53 and FIG. 54 are status of the invention applied to a nut-locked type plug, whereof the coated component 1*a* is aligned in a same orientation, other possibilities of realization are too numerous to recite one by one, and without restriction too.

As illustrated in FIG. 55 and FIG. 56, the invention conductor coupling or control interface incorporating a convexo-concave coupling separator structure made from metal or otherwise material impervious to electromagnetic penetration finds convenient application in the form of a conductor pin or contact as part of a plug or socket, or as a switching element or pushkey element, or electric power to acoustic power speaker, or acoustic power to electric power microphone, or electric power to optic power lamp or display, or optic power to electric power solar board, or still as an insert circuit board assembly, like the one exemplified in FIG. 57, wherein coated component 1*h* composed of conductive metal laminate has one or more section thereof treated in labyrinthine geometry for laying, bound to circuit board 6*h,* thus forming a mutually shielding match with correspondingly shaped casing 3*h* made from metal or otherwise material impervious to electromagnetic penetration, said casing 3*h* defined as such preferably furnished with one or more row of crisscross deployed coupling stem 31*h* or coupling hole 32*h,* with both terminating ends mounted with padding 33*h* to account for a convexo-concave structure serving as a labyrinthine electromagnetic barrier;

Further, as shown in FIG. 58, the invention as applied to a circuit board structure may be arranged such that said metal or casing 3*h*' made from otherwise material impervious to electromagnetic penetration is mounted with one or more row of interwovenly distributed coupling stem 31*h*' or coupling hole 32*h*', to account for a convexo-concave structure serving as a labyrinthine electromagnetic barrier;

Or still as shown in FIG. 59, the invention as applied to a circuit board structure may be designed so that a convexo-concave coupling separation 2*h* is composed way between aforementioned coated component 1*h* which consists of a row of conductive metal sheet and a casing 3*h* made of metal or otherwise material impervious to electromagnetic penetration to make the invention in the form of a labyrinthine electromagnetic barrier;

Basing on the same rationale, the invention labyrinthine electromagnetic barrier embodied in a convexo-concave insulation structure is equally good for application in the switching elements or pushkey elements of otherwise control interface, as exemplified in FIG. 60 and FIG. 61, by having one or more section of the pushkey element 1*i* taken the shape of a labyrinthine geometry, for example, curved, annularly convex or annularly concave, or configured to resemble a bent elbow, or to be obliquely bent, way between said switching element or pushkey element 1*i,* insulator 2*i* and casing 3*i* made of metal or otherwise material permissive of mutual, interactive shielding impervious to electromagnetic penetration, so as to form an isolation effect together with a suitable insulator 2*i,* tight against said casing 3*i* defined hereinbefore, thus consummating a convexo-concave labyrinthine obstruction to electromagnetic penetration.

Referring now to FIG. 62, FIG. 63, and FIG. 64, FIG. 65, altogether, it will be appreciated that the invention will permit the coated component 1*i* to bear the profile of a conductor row comprising one or more parallel wire connected to a conductor coupling or control interface which in turn is attached to casing 3*j* made of a metal or one made of a material impervious to electromagnetic penetration, said casing 3*j* defined as such forms labyrinthine barrier of a convexo-concave geometry, by engaging an insulator 2*j* way between the coated component 1*i* and the casing 3*j,* a labyrinthine barrier serving to block and obstruct electromagnetic penetration is substantiated, and that pursuant to the invention. By the same token, as shown in FIG. 66, FIG. 67, the invention is also good for embodiment to be a coated component 1*j* comprising printing type soft wire row to be wrapped up by a casing 3*k* having a chosen labyrinthine geometry and composed of metal or material impervious to electromagnetic penetration, in a convexo-concave coupling insulation layout, for example, and the outer layer of the coated component 1*j* for printing type soft wire row is isolated with insulator 2*k,* to be connected by said printing type soft wire row to a conductor coupling or control interface, to account for a labyrinth obstruction to electromagnetic penetration, prosecuted according to the invention.

Figure 68:
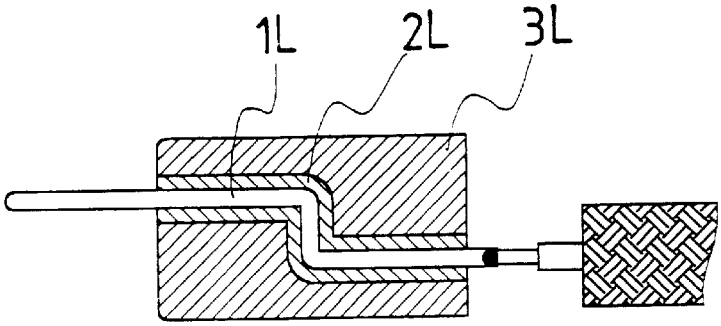
FIG. 68 is a cross-section of the coated component executed in an elbow pursuant to the invention.
Figure 69:
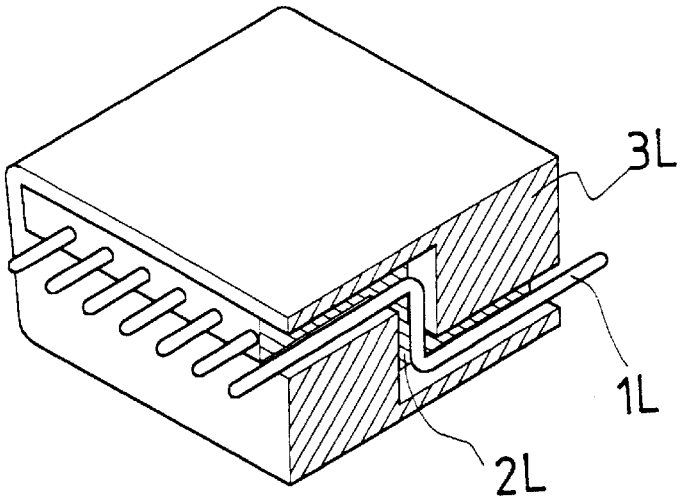
FIG. 69 is a partial section of the three-dimensional assembly prosecuted as illustrated in FIG. 68.
Figure 70:
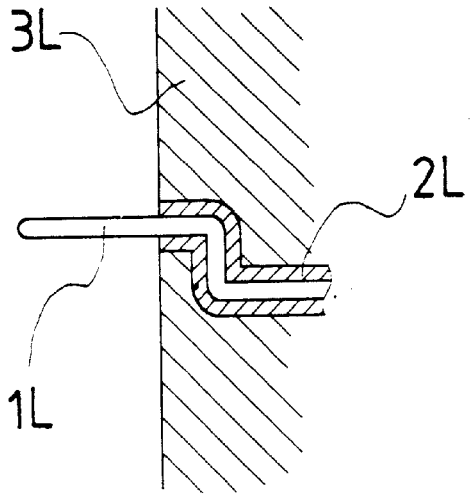
FIG. 70 is a cross-section view of a Casing made of metal base or other material capable of isolating electromagnetic waves planted with a coated component executed in an elbow form according to the invention.
Figure 71:
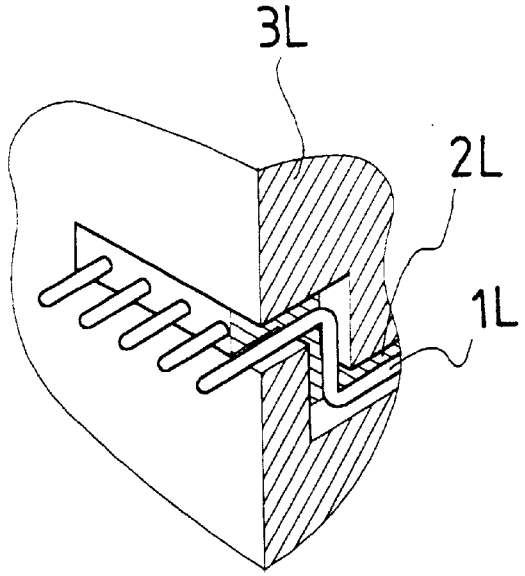
FIG. 71 is a partial cross-section view of the three-dimensional assembly shown in FIG. 70.

The disclosure going this far serves in no way to restrict the implementation of this invention in any manner, and, apart from the aforementioned executions, what are represented in FIG. 68 and FIG. 69 are altogether a coated component 1L bearing a labyrinthine configuration comprising one or more section, or alternatively in the form of a bent elbow which is isolated by one matching insulator 2L, together with a casing 3L composed of a counterpart, mutually shielding adaptor or the metal which is the control interface itself, or other material which forms a barrier to electromagnetic penetration, or still said coated component 1L may be bonded tight with matching metal or a casing made from other material impervious to electromagnetic penetration (as shown in FIG. 70 and FIG. 71), in that manner constitutes a labyrinthine structure in convexo-concave isolation impervious to electromagnetic penetration.

Figure 72:
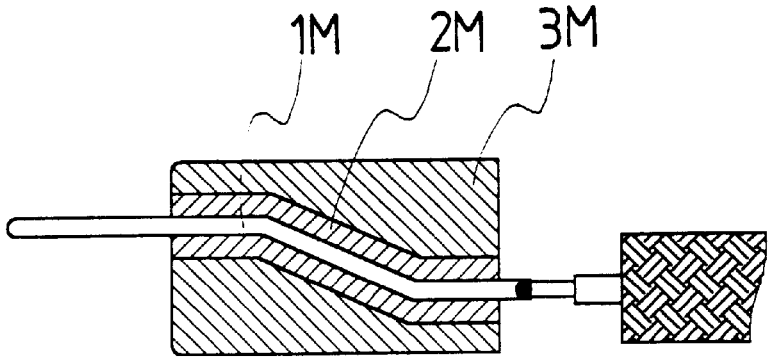
FIG. 72 is a cross-section view of a coated component according to the invention being obliquely planted and bent at the same time.
Figure 73:
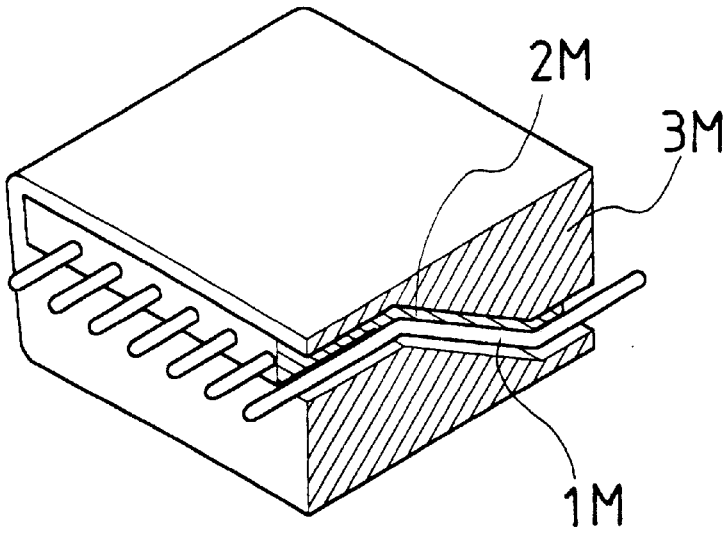
FIG. 73 is a partial cross-section view of the three-dimensional assembly shown in FIG. 70.

What is represented in FIG. 72 and FIG. 73 is a coated component 1M comprising one or more section of a chosen labyrinthine configuration or in the form of a bent elbow isolated by a matching insulator 2M, together with a casing 3M composed of a counterpart and mutually shielding adaptor or the metal part that is the control interface itself or made from other material impervious to electromagnetic penetration, or instead said coated component 1M may be bonded straight with matching metal or a casing made from otherwise material impervious to electromagnetic penetration, so as to constitute a labyrinthine structure in convexo-concave isolation impervious to electromagnetic penetration.

Figure 74:
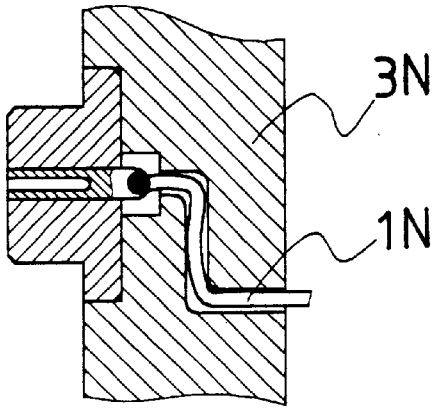
FIG. 74 is a side view of the cross-section of the invention labyrinthine structure impervious to electromagnetic penetration as applied to a conductor leader treated in a bent elbow.
Figure 75:
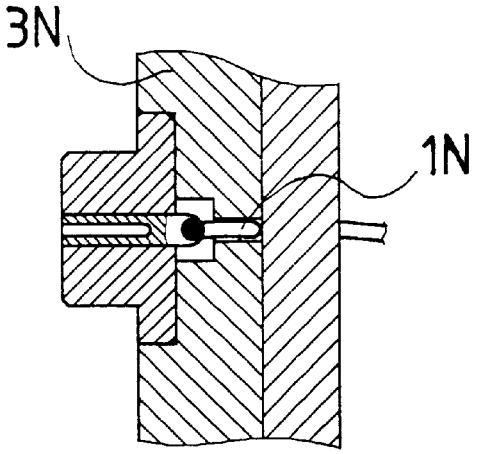
FIG. 75 is a top cross-section view of the invention labyrinthine structure impervious to electromagnetic penetration as applied to a conductor leader treated in a bent elbow.
Figure 76:
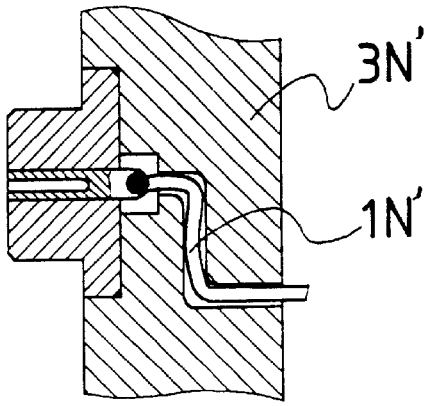
FIG. 76 is a side view of the cross-section of the invention labyrinthine structure impervious to electromagnetic penetration as applied to a row of conductor treated in a bent elbow.
Figure 77:
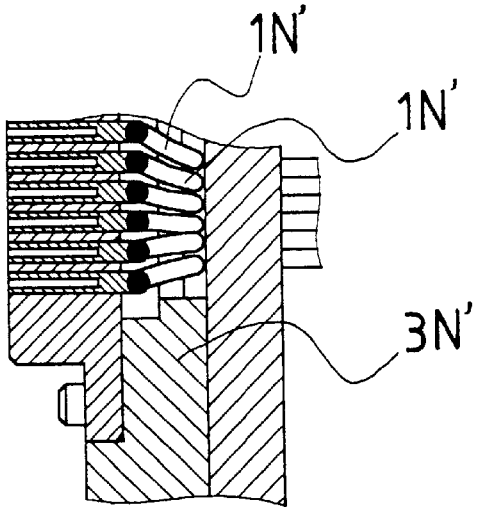
FIG. 77 is a top cross-section view of the invention labyrinthine structure impervious to electromagnetic penetration as applied to a row of conductor treated in a bent elbow.

By the same token, the invention by its structure may also be applied to conductor leader singly or to a row of conductor for conductive coupling purposes, an example in the case of single conductor leader as applied to a conductive adaptor being one as given in FIG. 74 and FIG. 75, whereof the marking 1N stands for single conductor leader, or alternatively as shown in an example of the invention in the form of a row of conductor applied to an adaptor shown in FIG. 76 and FIG. 77, the marking 1N' stands for said row of conductor; in either single conductor leader 1N or row of conductor 1N' is contained a metal-base coated component overlapped with an insulator coating, said single conductor leader 1N or row of conductor 1N' being treated in one or more section of a bent elbow with a given labyrinthine configuration, to form, together with a casing 3N or 3N' made of the metal part which is the control interface itself or a counterpart mutually shielding adaptor or otherwise material impervious to electromagnetic penetration, or alternatively through direct coupling with a matching metal or a casing shell made from otherwise material impervious to electromagnetic penetration, a labyrinthine structure impervious to electromagnetic penetration in convexo-concave isolation.

Figure 78:
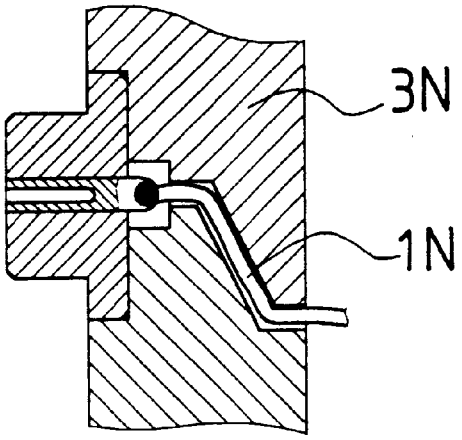
FIG. 78 is a side view of the cross-section of the invention labyrinthine structure impervious to electromagnetic penetration as applied to a row of conductor treated in an obliquely bent form.
Figure 79:
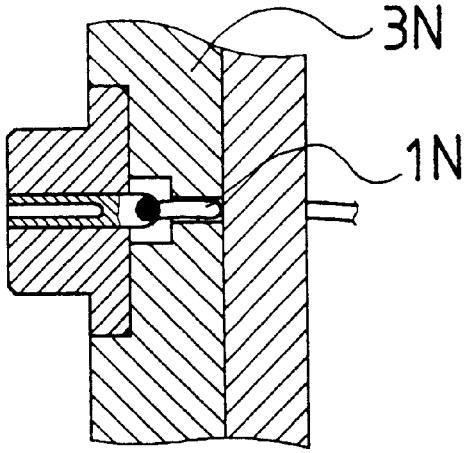
FIG. 79 is a top view of the cross-section of the invention labyrinthine structure impervious to electromagnetic penetration as applied to a conductor leader treated in an obliquely bent form.
Figure 80:
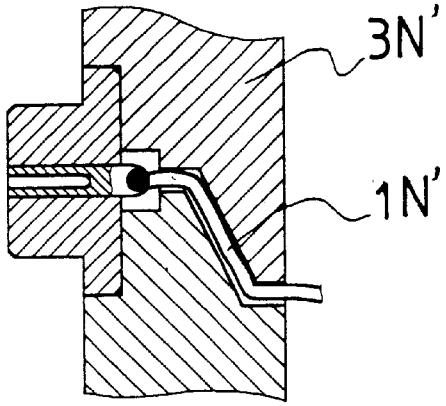
FIG. 80 is a side view of the cross-section of the invention labyrinthine structure impervious to electromagnetic penetration as applied to a row of conductor treated in a bent elbow.
Figure 81:
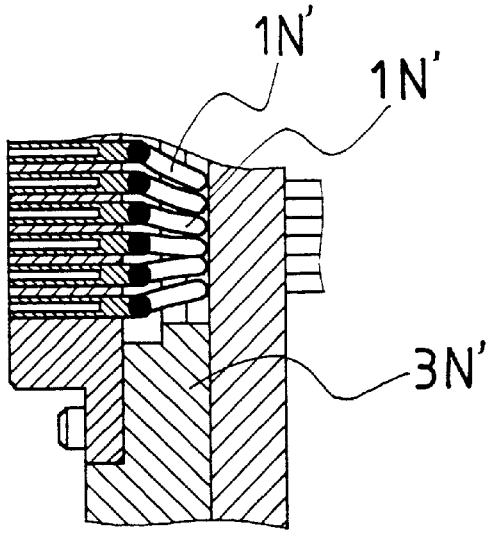
FIG. 81 is a top view of the cross-section of the invention labyrinthine structure impervious to electromagnetic penetration as applied to a row of conductor treated in a bent elbow.

By the same token, in the example of the invention as applied to single conductor leader of a conductive coupling shown in FIG. 78 and FIG. 79, the marking 1N stands for the single conductor leader; or as in the example as applied to a row of conductor associated with a coupling device illustrated in FIG. 80 and FIG. 81, the marking 1N' stands for said row of conductor; the idea is such that both single leader 1N and row of conductor 1N' are designed to contain metal-base coated component only to be overlapped with an insulator coating, and each being treated in the form of a bent elbow of one or more section of a given labyrinthine configuration, together with a counterpart mutually shielding coupling or a casing 3N or 3N' composed of the control interface itself or otherwise material impervious to electromagnetic penetration, or alternatively through direct attachment to a matching metal or a casing composed of otherwise material impervious to electromagnetic penetration, a labyrinthine barrier to electromagnetic penetration in convexo-concave isolation.

Figure 82:
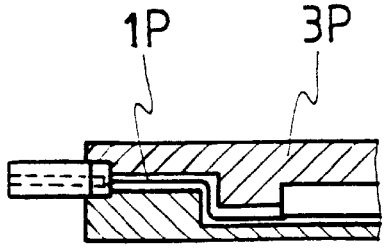
FIG. 82 is a side view of the cross-section of the invention labyrinthine structure impervious to electromagnetic penetration as applied to a row of soft wire being packed in a bent elbow; for printing industry.
Figure 83:
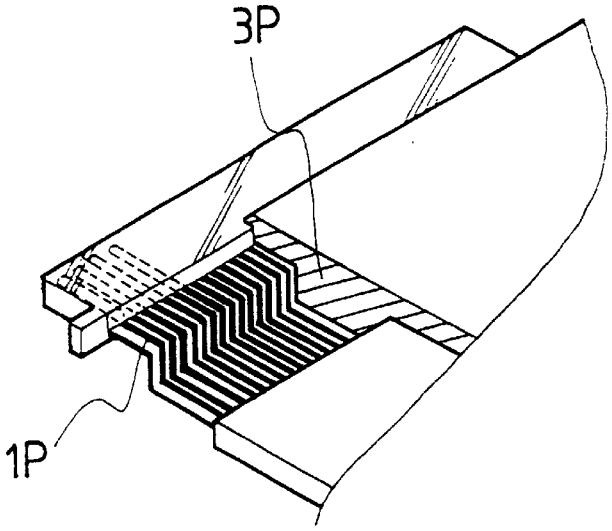
FIG. 83 is a three-dimensional perspective of what is shown in FIG. 82.

Further, as shown in FIG. 82 and FIG. 83, the invention is also good for application in the case of printing purpose row of soft wire in connection with conductor coupling or with a control interfacing, and in the form of a labyrinthine barrier to electromagnetic penetration in convexo-concave isolation featuring a soft row of wire 1P with an overlayer of isolation, treated in the form of a bent elbow of one or more section of a given labyrinthine configuration and a casing 3P which incorporates a counterpart mutually shielding coupling or the metal that is the control interfacing itself or made from otherwise material impervious to electromagnetic penetration combined in tight embodiment.

Figure 84:
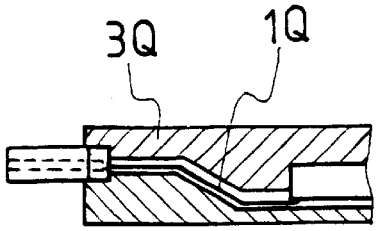
FIG. 84 is a side view of the cross-section of the invention labyrinthine structure impervious to electromagnetic penetration as applied to a row of soft wire being packed in a bent elbow, for printing industry.
Figure 85:
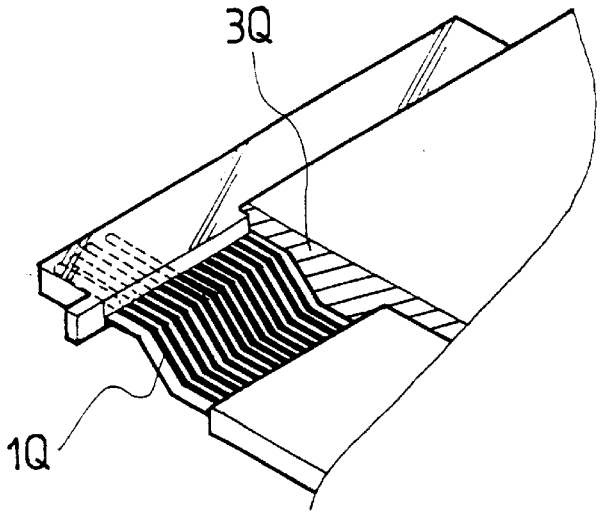
FIG. 85 is a three-dimensional perspective of what is shown in FIG. 84.

By the same token, as shown in FIG. 84 and FIG. 85, when applied in the case of a printing purpose row of soft wire associated with a conductive coupling or control interfacing, to form a labyrinthine barrier to electromagnetic penetration in convexo-concave isolation, whereof the overlayer may contain a row of soft wire 1Q duly protected by insulation and in the form of one or more section of obliquely bent labyrinth consummated in tight bond with a shell casing 3Q incorporating a counterpart mutually shielding adaptor or a metal part which is the control interfacing itself or else made from otherwise material impervious to electromagnetic penetration, or alternative through direct coupling with a shell casing made of a matching metal or otherwise material impervious to electromagnetic penetration.

Figure 86:
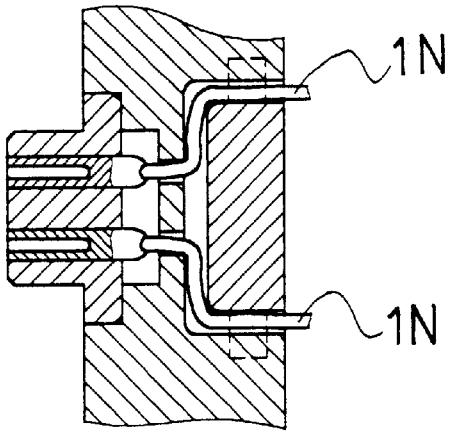
FIG. 86 is a side view of a cross-section of the invention labyrinthine structure impervious to electromagnetic penetration as applied to a bent double elbow conductor leader each being attached to the adaptor of one conductor coupling.
Figure 87:
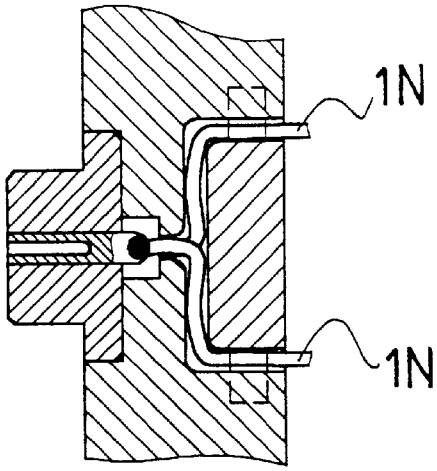
FIG. 87 is a side view of the cross-section of the invention labyrinthine structure impervious to electromagnetic penetration as applied to a bent double elbow conductor leader sharing a same conductor coupling.

Example of single conductor leader as applied to a conductive coupling according to the invention may be executed as per illustrations of FIG. 86 or FIG. 87, whereof two leaders 1N are each attached to or both share one set of conductive coupling, the leader 1N containing metal enclosure within with an overcoating of insulation and each 1N comprising an bent elbow of one or more section in a labyrinthine configuration, or alternatively bearing a branched profile such as is shown in FIG. 78, bending obliquely, and forms, with a casing 3N or 3N' which incorporates a counterpart, mutually shielding coupling or which is the metal part that is the control interfacing itself or made from otherwise material impervious to electromagnetic penetration, or else straight with a matching metal or a shell casing made from otherwise material impervious to electromagnetic penetration, a labyrinthine barrier to electromagnetic penetration secured in a convexo-concave isolation.

Figure 88:
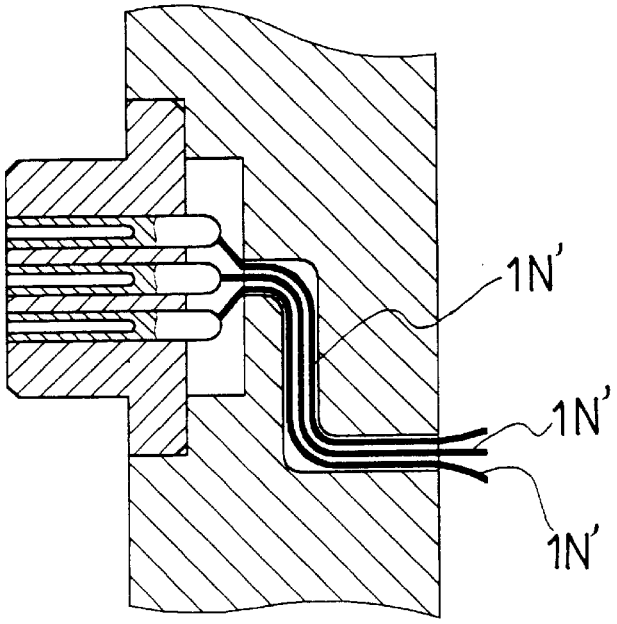
FIG. 88 is a side view of the cross-section of the invention labyrinthine structure impervious to electromagnetic penetration as applied to a multiple layered assembly of conductor array.
Figure 89:
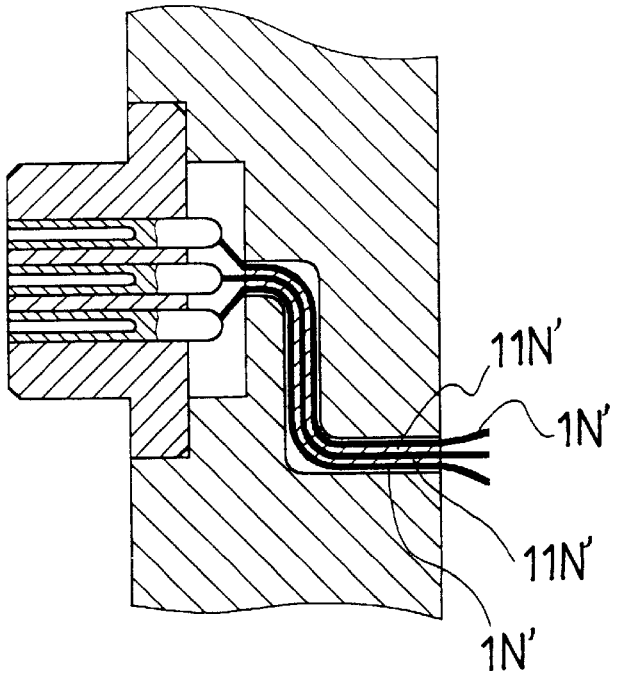
FIG. 89 is a side view of the cross-section of the invention labyrinthine structure impervious to electromagnetic penetration as applied to a multiple layered assembly of conductor array complete with isolation sheets composed of materials impervious to electromagnetic penetration.

The invention as applied in a coupling to a conductive row of wire is exemplified non-exclusively in FIG. 88, wherein the row of conductor 1N' may be executed in a single or multiple layer of assembly, comprising one or more section of a bent elbow of a labyrinthine configuration or bearing a branched profile bent obliquely as illustrated in FIG. 80, which, together with a casing 3N' that incorporates a counterpart mutually shielding coupling or else in the form of the metal which is the control interfacing itself or else made from otherwise material impervious to electromagnetic penetration, or alternatively, through tight combination with a matching metal straight or otherwise material impervious to electromagnetic penetration, forms a labyrinthine barrier to electromagnetic penetration in convexo-concave isolation; as a variant shown in FIG. 89, it is also practicable to interpose amongst respective rows of conductor 1N', of multiple layer assembly, isolation sheets 11N' made from materials impervious to electromagnetic penetration.

Figure 90:
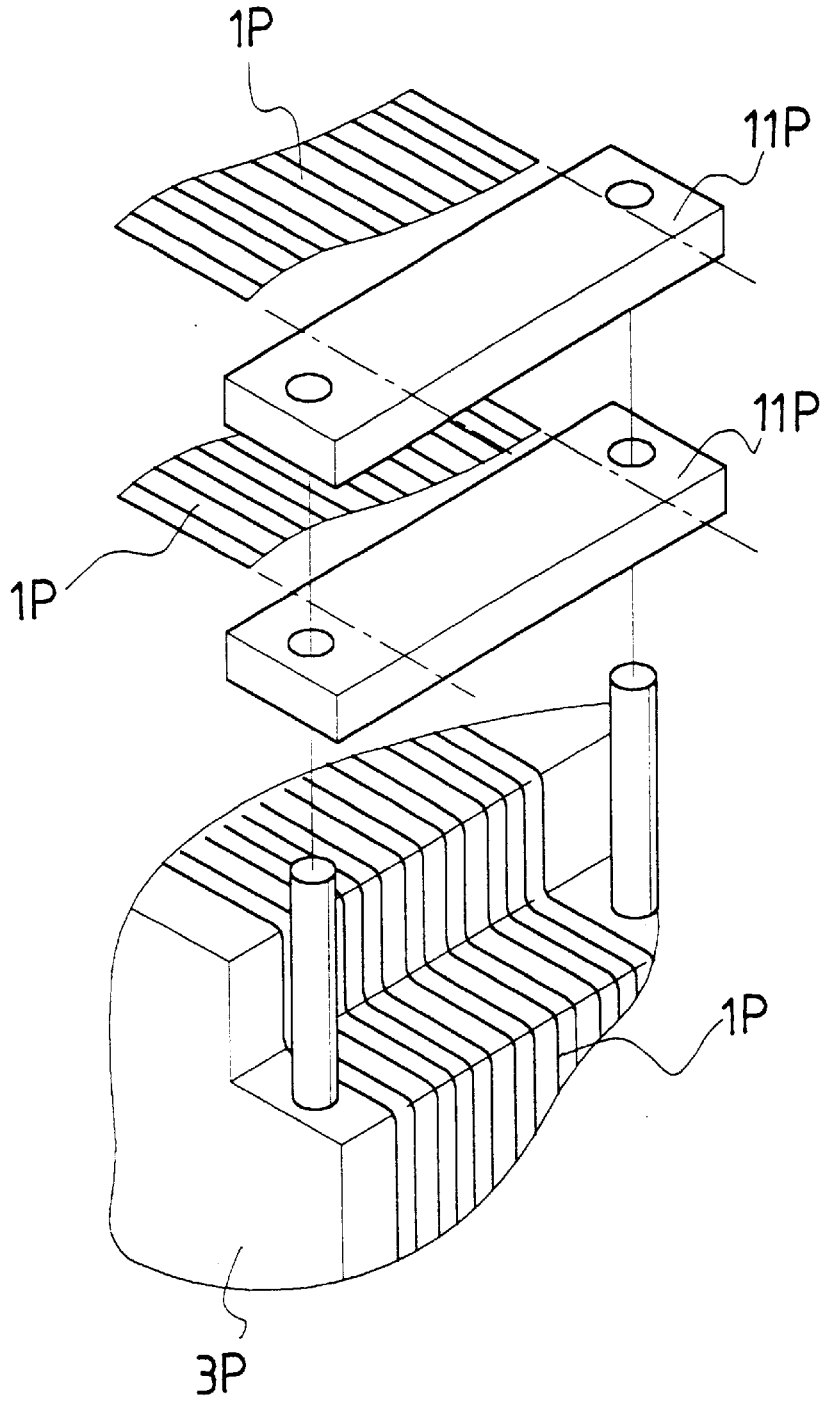
FIG. 90 is an illustration of the invention labyrinthine structure impervious to electromagnetic penetration as applied to a conductive coupling or to a multiple layered assembly of row of soft wire, as employed in the printing industry, as part of a control interface.

Referring in continuation to FIG. 90, it will be seen that when applied to a conductive coupling means or to printing purpose row of soft wire as part of a control interfacing, the invention may be executed such that the multiple layered row of soft wire 1P is processed into a bent elbow of one or more section in a given labyrinthine configuration or alternatively in such a multiple layered layout comprising oblique bends as is shown in FIG. 84, only to be interposed with isolation sheets 11P made from materials impervious to electromagnetic penetration, so as to form a labyrinthine barrier to electromagnetic penetration in convexo-concave isolation with a casing 3P which incorporates a counterpart mutually shielding coupling means or which is in itself the metal part of the control interfacing or which is made from otherwise material impervious to electromagnetic penetration, or alternatively through tight combination with a shell casing made from otherwise material impervious to electromagnetic penetration or from a matching metal instead.

The disclosure going thus far, embodiments and realizations described inclusive, are not meant to restrict the scope of application of the invention, but instead to exemplify is scope of application, by the name Conductor Coupling or Control Interface incorporating a convexo-concave coupling labyrinth separator for separation from electromagnetic waves the invention applies extensively to conductor pin or contact of every description associated with a plug, a socket assembly, switching element for a control interface, pushkey elements, devices exhibiting acoustic power converted from electric power, a loudspeaker, for example, devices exhibiting electric power converted from acoustic energy, a microphone, for example, devices exhibiting optic power converted from electric power, a lamp or display, for example, devices exhibiting electric power converted from optic power, solar boards, for example, as to which our Claims are stated hereinbelow. In addition, covering or coating or casing made for any of aforementioned metal or materials impervious to electromagnetic penetration, may be chosen from non-metallic materials suitable for use as an overlayer, in respect of which the composition is dictated by the need on a case by case basis, of which further description is saved and omitted.

Figure 91:
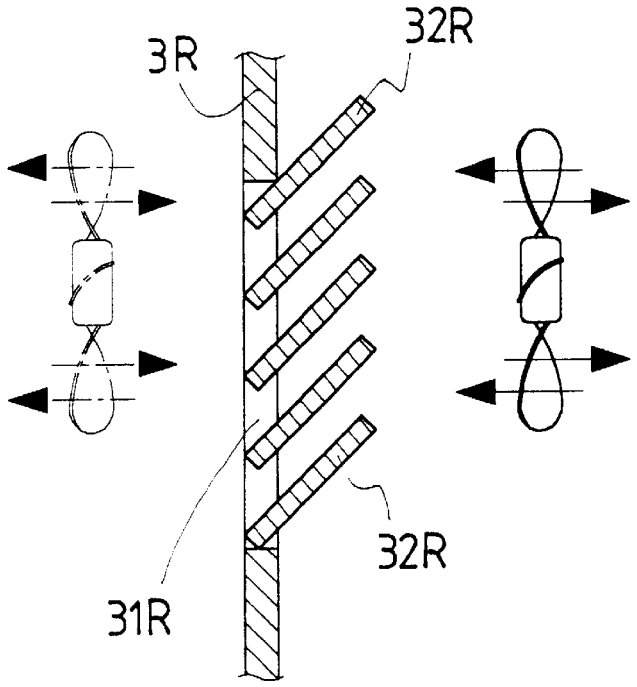
FIG. 91 is a cross-section view of the invention labyrinthine structure impervious to electromagnetic penetration as applied to the intake/outlet port of the Casing Shell which is part thereof.

A further application that is possible with the invention design of a labyrinthine barrier to electromagnetic penetration in convexo-concave isolation is with regard to the intake/outlet port of a shell casing made from any material which is impervious to electromagnetic penetration, and that accomplished by the mounting of assembly of sheets impervious to electromagnetic penetration of suitable labyrinthine configuration on said intake/outlet port, to accommodate coupling with a shell casing 3R made of metal or other material impervious to electromagnetic penetration, so as to constitute a labyrinthine barrier to electromagnetic penetration in convexo-concave isolation, such as is exemplified in FIG. 91, in the form of an intake/outlet port 31R installed onto the shell casing 3R that is composed of material impervious to electromagnetic penetration, furnished with obliquely bent isolation sheets 32R in alternating layout to reinforce ventilation effect assuring heat diffusion and isolation of electromagnetic transmission.

Figure 92:
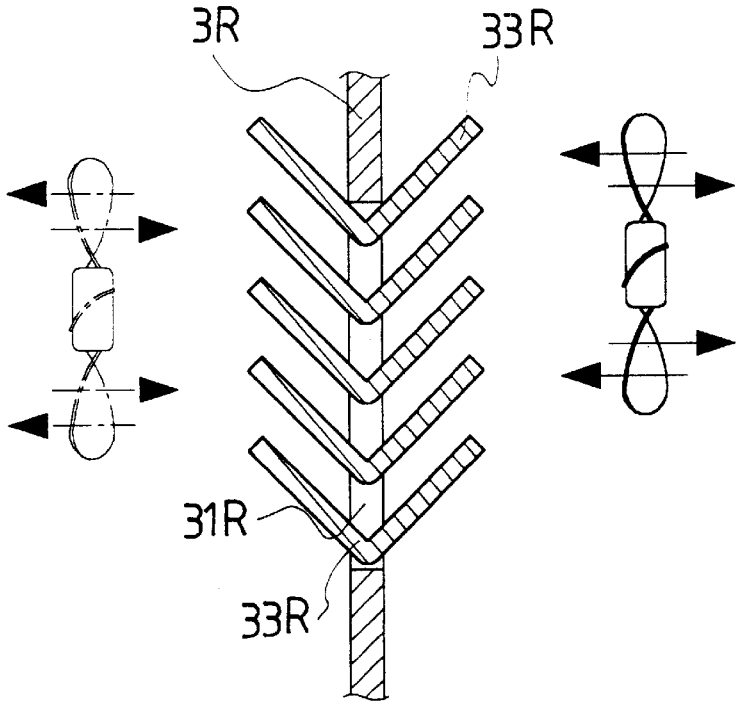
FIG. 92 is a cross-section view of another example of the invention labyrinthine structure impervious to electromagnetic penetration as applied to the intake/outlet port of the Casing Shell which is part thereof; and, FIG. 93 is still another example of the invention labyrinthine structure impervious to electromagnetic penetration as applied to the intake/outlet port which is part thereof.
Figure 93:
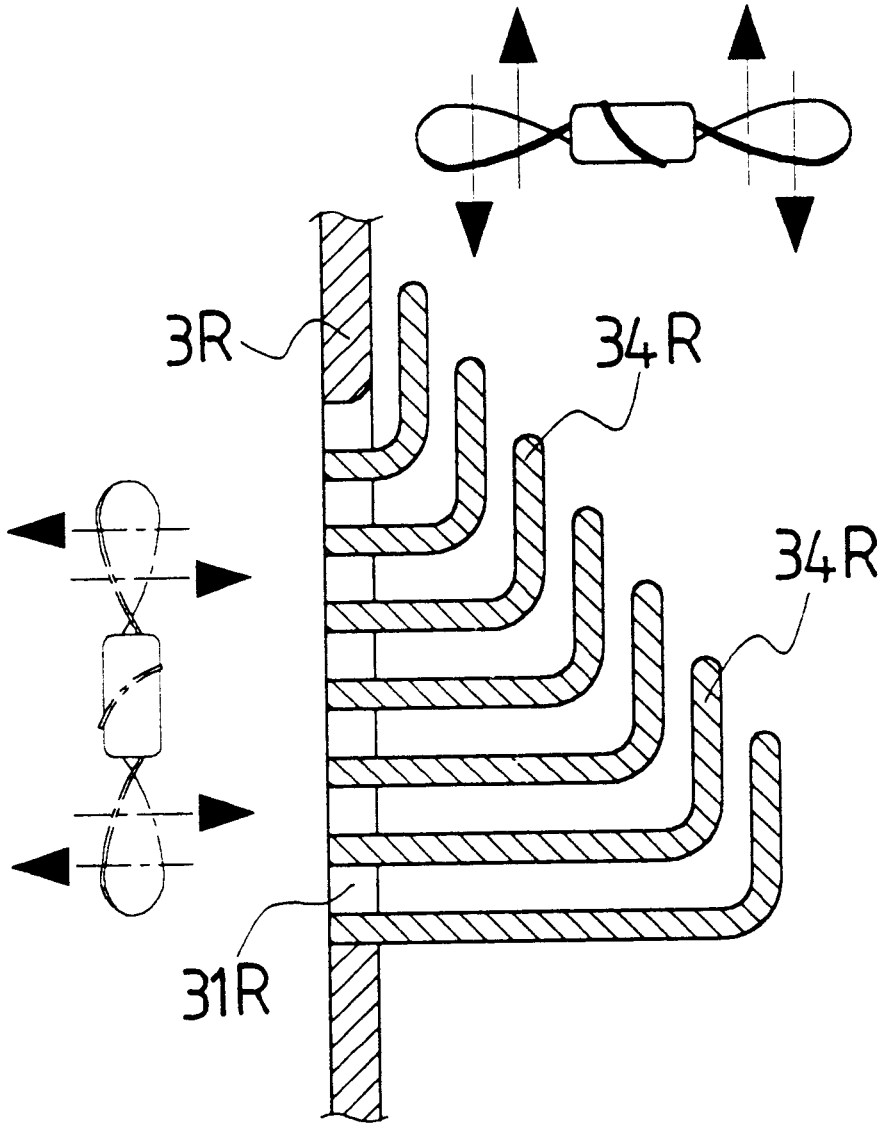

By the same token, what is shown in FIG. 92 is a variant example of an intake/outlet port 31R installed onto a shell casing 3R made of material impervious to electromagnetic penetration, furnished complete with sheet assembly 33R of alternating layout, bent bi-directionally and impervious to electromagnetic penetration, to serve heat diffusion and electromagnetic isolation purposes; whereas what is shown in FIG. 93 is another model of intake/outlet port 31R installed onto a shell casing 3R made of materials impervious to electromagnetic penetration, laid out in a bent elbow essentially labyrinthine and comprising electromagnetic isolation sheet assembly 34R in alternating array to achieve heat diffusion, ventilation as well as electromagnetic isolation purposes.

In summation, the invention isolation structure of labyrinthine design impervious to electromagnetic penetration in convexo-concave layout as applied to a conductive coupling means or control interfacing provides isolation by processing one or more section of a chosen coated component into bent, convex, concave, otherwise geometric configuration and that matched with appropriate insulation, and that to be tightly united with a counterpart mutually shielding metal mass or a shell casing made of otherwise material impervious to electromagnetic penetration or alternatively directly combined with a matching metal, otherwise electromagnetic insulating material, configured in a symmetric, mutually shielding manner, to form a labyrinthine electromagnetic barrier executed in convexo-concave isolation fit for application at the intake/outlet port of a shell casing to exhibit electromagnetic obstructing effects in addition to heat diffusion and ventilation purposes.

What is claimed is:

1. Conductor Coupling or Control Interface incorporating a convexo-concave coupling labyrinth separator for separation from electromagnetic waves, comprising essentially: coated components as part of a conductor assembly or control interface, such as: conductor pin or contacts of a plug or socket assembly, switching elements or pushkey elements of a control interface, devices of acoustic power converted from electric power, those of electric power converted from acoustic power, those of optic power converted from electric power, and those of electric power converted from optic power, one-piece or assembled coating or covering components composed from insulator, closed (core filled), retiform or porous (hollow-set) metal or otherwise material impervious to electromagnetic penetration, whereof one or more section is treated curvatured, convex or concave, resembling a bent elbow, or obliquely bent, otherwise labyrinthine configured, suitably coupled with insulation to form a means of isolation, thence coupled by means of coupling or metal on the body of the control interface itself, or alternatively coating shell made from otherwise material impervious to electromagnetic penetration to form a tight coupling, the geometry being mutually shielding, for the purpose of convexo-concave isolation.

2. Conductor Coupling or Control Interface incorporating a convexo-concave coupling labyrinth separator for separation from electromagnetic waves according to claim 1, comprising essentially: component (1*a*) applied with a coating for conduction or as a control interface, insulator (2*a*), coating element composed of closed (core filled) or multiple holed (hollow-set) metal or otherwise electromagnetic wave insulant materials, executed in one-piece structure or assembled to form, a casing (3*a*); whereof the coated component (1*a*) can serve the purpose of a conductor pin or contact as part of a plug or socket assembly, a switching element for a control interface, or else a pushkey element, an electric energy to acoustic power device, a speaker, for example, an acoustic power to electric power device, a microphone, for example, an electric power to optic power device, a lamp or display, for example, or still an optic energy to electric power device, a solar board, for example, for execution, the coated component (1*a*) shall be of a labyrinthine geometry comprising one or more section of curved, annularly concave or annularly convexo configuration, or alternatively treated in a bent elbow or obliquely bent to be matched with a suitable insulator (2*a*) to form a barrier, to be thence securely bound to the coupling or the metal part of the control interface per se, or a casing (3*a*) made of otherwise electromagnetic wave insulant material, or alternatively bound directly to metal adaptors provided ad hoc or otherwise main casing made of otherwise material impervious to electromagnetic wave penetration, of mutually shielding geometry to make a convexo-concave inlay serving as a labyrinthine electromagnetic wave barrier structure, the covering or casing (3*a*) made from said metal or otherwise material impervious to electromagnetic penetration being circular, square, or otherwise shaped, one-piece or a combination of separate fragments, or alternatively integral with the metal body or the main shell casing made from otherwise material impervious to electromagnetic penetration, in respect of which holding strength is ensured by engaging convexities (31*a*) configured a mutually shielding manner within, in the form of either closed core filled mass or retiform or beehive, thus forming a realization of the invention Conductor Coupling or Control Interface incorporating a convexo-concave coupling labyrinth separator for separation from Electromagnetic Waves.

3. Conductor Coupling or Control Interface incorporating a convexo-concave coupling labyrinth separator for separation from electromagnetic waves according to claim 1 or claim 2, whereof said coated component (1*a*) is the conductor pin or contact that forms part of a plug or socket assembly, eventually coupled to wire components, and applied on the perimeter with or alternatively structurally integral with a one-piece insulator (2*a*) and a casing (3*a*) of metal base or otherwise material impervious to electromagnetic penetration, for execution into a plug or socket assembly.

4. Conductor Coupling or Control Interface incorporating a convexo-concave coupling labyrinth separator for separation from electromagnetic waves according to claim 1 or claim 2, whereof the binding of said casing (3*a*) that is made from metal base or otherwise material impervious to electromagnetic penetration with the coated component (1*a*), insulator (2*a*) is executed such that the upper lid is set apart from the lower lid before both are coupled or locked together.

5. Conductor Coupling or Control Interface incorporating a convexo-concave coupling labyrinth separator for separation from electromagnetic waves according to claim 1 or claim 2, whereof said casing (3*b*) of metal base or as made from otherwise material impervious to electromagnetic penetration is executed one-piece or a separable dependent component, meant to form a compression union with a sleeving component (5*b*), while the coated component (1*b*) being planted within is planted singly or plurally in a same orientation or in opposite symmetry for coupling purposes, with insulator (2*b*) applied in-between, to consummate a convexo-concave labyrinth barrier to electromagnetic penetration.

6. Conductor Coupling or Control Interface incorporating a convexo-concave coupling labyrinth separator for separation from electromagnetic waves according to claim 1 or claim 2, whereof the planting of said coated component (1*b*) executed in a double layered or multiple layered vertically arrayed or traversely arrayed layout, or alternatively in just a single layered layout, and that reinforced with an insulator (2*b*) for isolation, which furthermore, is coupled to metal (3*b*) that is the control interface itself or a coating shell made from otherwise material impervious to electromagnetic penetration or directly to ad hoc metal or the Main Unit casing made from otherwise material impervious to electromagnetic penetration to form a secured coupling, thus realizing a convexo-concave mutually shielding coupling/barrier labyrinth serving the purpose of isolation of electromagnetic penetration.

7. Conductor Coupling or Control Interface incorporating a convexo-concave coupling labyrinth separator for separation from electromagnetic waves according to claim 1 or claim 2, whereof said coated component (1*c*) is treated such that one or more section thereof is processed to bear a labyrinthine geometry, curved trapezoidally, for example, to shorten the diameter of the casing (3*c*) which is made of metal of a symmetrically complementary geometry or otherwise material impervious to electromagnetic penetration, so that the overall assembly benefits from size compactness, that, in combination with insulator (2*c*) or metal or a casing (3*c*) made from otherwise material impervious to electromagnetic penetration, forms a convexo-concave labyrinthine barrier to electromagnetic transmission, configured in geometric symmetry.

8. Conductor Coupling or Control Interface incorporating a convexo-concave coupling labyrinth separator for separation from electromagnetic waves according to claim 1 or claim 2, whereof said labyrinthine configuration chosen for one or more section of said coated component (1*d*) can be wavy form, entirely or partially regular or irregular curved or serrated form, parallel bent or helicoidally three-dimensionally curvatured, complementing and complementary to the configuration of the casing (3*d*) that is made of metal base or otherwise material impervious to electromagnetic penetration or with regard to insulator (2*d*), to consummate a convexo-concave, mutual shielding labyrinthine barrier safeguarding against electromagnetic penetration.

9. Conductor coupling or Control Interface incorporating a convexo-concave coupling labyrinthine separator for separation from electromagnetic waves according to claim 1 or claim 2, whereof the coated component (1*f*) has one or more section thereof configured labyrinthine complete with entirely or partly distributed regularly or irregularly shaped convexities (11*f*) to mutual shield and match correspondently shaped insulation (2*f*) or casing (3*f*) which is metal or made of otherwise material impervious to electromagnetic penetration.

10. Conductor Coupling or Control Interface incorporating a convexo-concave coupling labyrinthine separator for separation from electromagnetic waves according to claim 1 or claim 2, whereof the coated component (1*g*) has one or more section thereof configured labyrinthine complete with entirely or partly distributed regularly or irregularly shaped concavities (11*g*) to mutually shield and match correspondently shaped insulation (2*g*) or casing (3*g*) which is metal or made of otherwise material impervious to electromagnetic penetration.

11. Conductor Coupling or Control Interface incorporating a convexo-concave coupling labyrinthine separator for separation from electromagnetic waves according to claim 1 or claim 2, whereof application of said coated component is not restricted only to plug, but will extend equally suitably to socket assembly, such that coated components (1*a*', 1*b*', 1*c*', 1*d*', 1*e*', 1*f*'), and (1*g*') are conveniently convertible into socket components by merely suitably adapting the coupling portion where pertinent; said coated component being singly or plurally planted in a same orientation or in opposite symmetry, as dictated by the requirement of application.

12. Conductor Coupling or Control Interface incorporating a convexo-concave coupling labyrinthine separator for separation from electromagnetic waves according to claim 1 or claim 2, whereof applications include adaption of insert type conductor into male socket by wrapping up the male coated component (1*a*) with an insulator (2*a*) only to be packed thereafter with a casing (3*a*) overall.

13. Conductor Coupling or Control Interface incorporating a convexo-concave coupling labyrinthine separator for separation from electromagnetic waves according to claim 1 or claim 2, whereof applications include adaptation of insert type conductor into female socket by wrapping up the female coated component (1*a*) with an insulator (2*a*) only to be packed with a casing (3*a*) overall afterwards.

14. Conductor Coupling or Control Interface incorporating a convexo-concave coupling labyrinth separator for separation from electromagnetic waves according to claim 1 or claim 2, whereof applications include a transfer relay comprising a plug compartment on one end, and a socket compartment on the other end.

15. Conductor Coupling or Control Interface incorporating a convexo-concave coupling labyrinth separator for separation from electromagnetic waves according to claim 1 or claim 2, whereof applications include adaptation to nut-lock type plug which consists of a coated component (1*a*) on the male end or female end, an insulator (2*a*) and a casing (3*a*), with said coated component (1*a*) being arrayed by symmetry.

16. Conductor Coupling or Control Interface incorporating a convexo-concave coupling labyrinth separator for separation from electromagnetic waves according to claim 1 or claim 2, whereof applications include adaptation to nut-lock type plug of which the coated component (1*a*) is laid out in a same orientation.

17. Conductor Coupling or Control Interface incorporating a convexo-concave coupling labyrinth separator for separation from electromagnetic waves according to claim 1 or claim 2, whereof applications include conductor pin or contacts of socket or plug assemblies, switching or pushkey elements of control interfaces, acoustic appliances sourced to electric power exemplified by a loudspeaker, electric appliances sourced to acoustic power exemplified by a microphone, optic appliances sourced to electric power exemplified by a lamp, or display, or electric appliances sourced to optic power exemplified by a solar board.

18. Conductor Coupling or Control Interface incorporating a convexo-concave coupling labyrinth separator for separation from electromagnetic waves according to claim 1 or claim 2, whereof applications include Insert Type ckt. board assemblies, using coated component (1*h*) composed of rows of metal conductor laminates whereof one or more section is configured labyrinthine, and in that manner applied onto the ckt. board (6*h*) to mutually shield and match correspondingly shaped casing (3*h*) made of metal or otherwise material impervious to electromagnetic penetration, said casing (3*h*) defined as such being available for the laying of one or more row of interwovenly distributed coupling stems (31*h*) or coupling holes (32*h*) with both rims elevated with padding (33*h*), to form a convexo-concave barrier structure impervious to electromagnetic penetration.

19. Conductor Coupling or Control Interface incorporating a convexo-concave coupling labyrinth separator for separation from electromagnetic waves according to claim 1 or claim 2, whereof application to circuit board fabrication includes processing of aforementioned casing (3*h*') made from metals or otherwise material impervious to electromagnetic penetration is furnished with interwovenly arrayed coupling stems (31*h*'), coupling holes (32*h*'), laid out in one or more row, to form a convexo-concave barrier structure resembling a labyrinth impervious to electromagnetic penetration.

20. Conductor Coupling or Control Interface incorporating a convexo-concave coupling labyrinth separator for separation from electromagnetic waves according to claim 1 or claim 2, whereof application to circuit board fabrication includes the interposition of an insulation (2*h*) way between the coated component (1*h*) which consists of a row of conductor metal sheets and a casing (3*h*) composed of otherwise material impervious to electromagnetic penetration to make a labyrinthine barrier structure impervious to electromagnetic penetration.

21. Conductor Coupling or Control Interface incorporating a convexo-concave coupling labyrinth separator for separation from electromagnetic waves according to claim 1 or claim 2, whereof application includes adaptation to switching or pushkey elements, characterized in that way between the switching or pushkey element (1*i*), insulator (2*i*) and a casing (3*i*) made of metal or otherwise material impervious to electromagnetic penetration, the pushkey element (1*i*) has one or more section thereof configured in a bent elbow, or obliquely bent curvature or convexity, concavity, by all means labyrinthine, to mutually shield and match the suitable insulator (2*i*) in order to form a barrier structure with respect to said casing (3*i*), correspondently configured, impervious to electromagnetic penetration.

22. Conductor Coupling or Control Interface incorporating a convexo-concave coupling labyrinth separator for separation from electromagnetic waves according to claim 1 or claim 2, whereof the coated component (1*i*) is also executed to be in the form of one row of conductor lining up side by side plurally interconnected with conductor coupling or control interface which in turn is covered overall in a casing (3*j*)made of metal or otherwise material impervious to electromagnetic penetration to thereby form a convexo-concave labyrinth barrier structure impervious to electromagnetic penetration by dint of the interposition of insulator (2*j*) between the coated component (1*i*) and the casing (3*j*).

23. Conductor Coupling or Control Interface incorporating a convexo-concave coupling labyrinth separator for separation from electromagnetic waves according to claim 1 or claim 2, whereof application includes adaptation to a coated component (1*j*) composed of printing type soft wire row which is covered overall by a casing (3*k*) made of metal or otherwise material impervious to electromagnetic penetration laid out in a labyrinthine convexo-concave configuration, and same is isolated by an insulation (2*k*) applied over the periphery of said coated component (1*j*), with the printing type soft wire row coupled to a conductor coupling or control interface to conclude a labyrinthine structure impervious to electromagnetic penetration.

24. Conductor Coupling or Control Interface incorporating a convexo-concave coupling labyrinthine separator for separation from electromagnetic penetration according to claim 1 or claim 2, which is executed to be a coated component (1L) comprising one or more section and bearing a labyrinthine configuration, or alternatively in the form of a bent elbow which is isolated by a matching insulator (2L), together with a casing (3L) composed of a counterpart, mutually shielding adaptor or the metal which is the control interface itself, or other material which forms a barrier to electromagnetic transmission, or still said coated component (1L) may be bonded tight with matching metal or a casing made from other material impervious to electromagnetic penetration, in that manner constitutes a labyrinthine structure in convexo-concave isolation impervious to electromagnetic penetration.

25. Conductor Coupling or Control Interface incorporating a convexo-concave coupling labyrinthine separator for separation from electromagnetic penetration according to claim 1 or claim 2, as executed in a coated component (1M) comprising one or more section of a chosen labyrinthine configuration or in the form of a bent elbow isolated by a matching insulator (2M), together with a casing (3M) composed of a counterpart and mutually shielding adaptor or the metal part that is the control interface itself or made from other material impervious to electromagnetic penetration, or instead said coated component (1M) may be bonded straight with a matching metal or a casing made from otherwise material impervious to electromagnetic penetration, so as to constitute a labyrinthine structure in convexo-concave isolation impervious to electromagnetic penetration.

26. Conductor Coupling or Control Interface incorporating a convexo-concave coupling labyrinthine separator for separation from electromagnetic penetration according to claim 1 or claim 2, as applied to single conductor leader or to a row of conductor for conductive coupling purposes, whereof said single conductor leader (1N) or said row of conductor (1N') contains metal enclosure overlapped with an insulator coating, and each treated in one or more section of a bent elbow with a given labyrinthine configuration, to form, together with a casing (3N) or (3N') made of the metal part which is the control interface itself or a counterpart mutually shielding adaptor or otherwise material impervious to electromagnetic penetration, or alternatively through direct coupling with a matching metal or a casing shell made from otherwise material impervious to electromagnetic transmission, a labyrinthine structure impervious to electromagnetic penetration in convexo-concave isolation.

27. Conductor Coupling or Control Interface incorporating a convexo-concave coupling labyrinthine separator for separation from electromagnetic penetration according to claim 1 or claim 2, as applied to single conductor leader or to a row of conductor for conductive coupling purpose, whereof said single conductor leader (1N) or said row of conductor (1N') contains metal enclosure overlapped with an insulator coating, and each treated in one or more section of a bent elbow with a given labyrinthine configuration to form, together with a casing (3N) or (3N') made of the metal part which is the control interface itself or a counterpart mutually shielding adaptor or otherwise material impervious to electromagnetic penetration, or alternatively through direct coupling with a matching metal or a coating shell made from otherwise material impervious to electromagnetic transmission, a labyrinthine structure impervious to electromagnetic penetration in convexo-concave isolation.

28. Conductor Coupling or Control Interface incorporating a convexo-concave coupling labyrinthine separator for separation from electromagnetic penetration according to claim 1 or claim 2, as applied to printing purpose row of software in connection with conductor coupling or with a control interfacing, and in the form of a labyrinthine barrier to electromagnetic penetration in convexo-concave isolation featuring a row of soft wire (1P) with an overlayer of isolation, treated in the form of a bent elbow of one or more section of a given labyrinthine configuration and a casing (3P) which incorporates a counterpart mutually shielding coupling or the metal that is the control interfacing itself or made from otherwise material impervious to electromagnetic penetration combined in tight embodiment.

29. Conductor Coupling or Control Interface incorporating a convexo-concave coupling labyrinthine separator for separation from electromagnetic penetration according to claim 1 or claim 2 as applied in the case of printing purpose row of soft wire in connection with a conductive coupling or control interface, to form a labyrinthine barrier to electromagnetic penetration in convexo-concave isolation, whereof the overpayer may contain a row of soft wire (1Q) duly protected by insulation and in the form of one or more section of obliquely bent labyrinth consummated in tight combination with a shell casing (3Q) incorporating a counterpart mutually shielding adaptor or a metal part which is the control interfacing itself or else made from otherwise material impervious to electromagnetic penetration or alternatively through direct coupling with a shell casing made of a matching metal or otherwise material impervious to electromagnetic penetration.

30. Conductor Coupling or Control Interface incorporating a convexo-concave coupling labyrinthine separator for separation from electromagnetic penetration according to claim 1 or claim 2, whereof two leaders (1N) are each attached to or both share one set of conductive coupling, the leader (1N) containing metal enclosure within an overcoating of insulation and each (1N) comprising a bent elbow of one or more section in a labyrinthine configuration, or alternatively bearing a branched profile, bending obliquely, and forms, with a casing (3N) or (3N') which incorporates a counterpart, mutually shielding coupling or which is the metal part that is the control interfacing itself or made from otherwise material impervious to electromagnetic penetration, or else straight with a metal or a shell casing made from otherwise material impervious to electromagnetic penetration, a labyrinthine barrier to electromagnetic penetration secured in a convexo-concave isolation.

31. Conductor Coupling or Control Interface incorporating a convexo-concave coupling labyrinthine separator for separation from electromagnetic penetration according to claim 1 or claim 2, as applied in a coupling to a conductive row of wire, wherein the row of conductor (1N') may be executed in a single or multiple layer of assembly, comprising one or more section of a bent elbow of a labyrinthine configuration or bearing a branched profile bent obliquely which, together with a casing (3N') that incorporates a counterpart mutually shielding coupling or else in the form of the metal which is the control interfacing itself or else made from otherwise material impervious to electromagnetic penetration, or alternatively, through tight combination with a matching metal straight or otherwise material impervious to electromagnetic penetration, forms a labyrinthine barrier to electromagnetic penetration in convexo-concave isolation, it is also practicable to interpose amongst respective rows of conductor (1N'), or multiple layer assembly, isolation sheets (11N') made from materials impervious to electromagnetic penetration.

32. Conductor Coupling or Control Interface incorporating a convexo-concave coupling labyrinthine separator for separation from electromagnetic penetration according to claim 1 or claim 2, as applied to a conductive coupling means or to printing purpose row of soft wire as part of a control interfacing, executed such that the multiple layered row of soft wire (1P) is processed into a bent elbow of one or more section in a given labyrinthine configuration or alternatively in such a multiple layered layout comprising oblique bends as only to be interposed with isolation sheets (11P) made from materials impervious to electromagnetic penetration, so as to form a labyrinthine barrier to electromagnetic penetration in convexo-concave isolation with a casing (3P) which incorporates a counterpart mutually shielding coupling means or which is in itself the metal part of the control interfacing or which is made from otherwise materials impervious to electromagnetic penetration, or alternatively through tight combination with a shell casing made from otherwise materials impervious to electromagnetic penetration or from a matching metal instead.

33. Conductor Coupling or Control Interface incorporating a convexo-concave coupling labyrinthine separator for separation from electromagnetic penetration according to claim 1 or claim 2, as applied onto the intake/outlet port of a shell casing made from materials impervious to electromagnetic penetration, and that accomplished by the mounting of assembly of sheets impervious to electromagnetic penetration of suitable labyrinthine configuration on said intake/outlet port, to accommodate coupling with a shell casing (3R) made of metal or other material impervious to electromagnetic penetration, so as to constitute a labyrinthine barrier to electromagnetic penetration in the form of an intake/outlet port (31R) installed onto the shell casing (3R) that is composed of material impervious to electromagnetic penetration, including furnishing of obliquely bent isolation sheets (32R) in alternating layout furnishing of bi-directionally bent isolation sheets (33R) impervious to electromagnetic penetration of alternating layout; furnishing of isolation sheet assembly (34R) impervious to electromagnetic penetration laid out alternatingly in a bent elbow, essentially labyrinthine configuration to produce heat diffusion, ventilating as well as electromagnetic isolation purpose.

* * * * *